US009971276B2

(12) United States Patent
Ishida et al.

(10) Patent No.: US 9,971,276 B2
(45) Date of Patent: May 15, 2018

(54) DEVELOPING MEMBER, METHOD OF PRODUCING DEVELOPING MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazutoshi Ishida, Mishima (JP); Yuji Sakurai, Susono (JP); Ryo Sugiyama, Mishima (JP); Rieko Takabe, Tokyo (JP); Sosuke Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/349,823

(22) Filed: Nov. 11, 2016

(65) Prior Publication Data

US 2017/0139346 A1 May 18, 2017

(30) Foreign Application Priority Data

Nov. 16, 2015 (JP) ..... 2015-224315

(51) Int. Cl.
*G03G 15/08* (2006.01)

(52) U.S. Cl.
CPC ..... *G03G 15/0818* (2013.01)

(58) Field of Classification Search
CPC ..... G03G 9/08755; G03G 9/09321; G03G 9/09392; G03G 9/0819; G03G 9/0825; G03G 15/0818; G03G 9/08797; G03G 9/09371; G03G 9/0804; G03G 9/0806; G03G 9/08795; G03G 9/0821; G03G 9/09328; G03G 15/023
See application file for complete search history.

(56) References Cited

U.S. PATENT DOCUMENTS

2015/0331342 A1* 11/2015 Yamaguchi ..... G03G 5/043 492/18

FOREIGN PATENT DOCUMENTS

JP 4-88381 A 3/1992
JP 5-072889 A 3/1993

* cited by examiner

*Primary Examiner* — Roy Y Yi
(74) *Attorney, Agent, or Firm* — Canon U.S.A., Inc. IP Division

(57) ABSTRACT

A developing member includes a conductive substrate, a conductive elastic layer on the conductive substrate, and a plurality of insulating domains on the conductive elastic layer, wherein the surface of the developing member includes the surfaces of the insulating domains and an exposed portion of the conductive elastic layer not covered with the insulating domains. The conductive elastic layer contains a resin and an anion, wherein the resin has a specific cationic structure synthesized from an ion conductive agent composed of a cation including at least one reactive functional group and an anion and a compound that can react to the ion conductive agent.

19 Claims, 5 Drawing Sheets

DEVELOPING MEMBER, METHOD OF PRODUCING DEVELOPING MEMBER, PROCESS CARTRIDGE, AND ELECTROPHOTOGRAPHIC APPARATUS

BACKGROUND

Field of the Disclosure

The present disclosure relates to a developing member used in an electrophotographic apparatus. The disclosure also relates to a method of producing a developing member, a process cartridge, and an electrophotographic apparatus.

Description of the Related Art

A developing method using a non-magnetic mono-component toner is known as an image forming method with an electrophotographic image forming apparatus (hereinafter shortened to "electrophotographic apparatus"), such as a copier or an optical printer. Specifically, a photosensitive drum serving as a rotatable electrostatic latent image carrier is charged with a roller-shaped charging means, such as a charging roller, and the surface of the charged photosensitive drum is exposed to laser light to form an electrostatic latent image. Subsequently, in a developing unit of the image forming apparatus, a toner regulating member applies the toner in a developing agent container onto a developing roller. The electrostatic latent image is developed by the toner at the contact portion between the photosensitive drum and the developing roller. The toner image on the photosensitive drum is then transferred onto a recording material, such as paper, in a transfer unit directly or via an intermediate transferring member. The toner image is fixed to the recording material by heat and pressure in a fixing unit, and the recording material having a fixed image is discharged outside the image forming apparatus.

In many of recent electrophotographic apparatuses, a non-magnetic mono-component developing method is used with a reduction in the size of the main body. A toner is supplied onto a developing roller by an elastic roller (hereinafter, referred to as toner supplying roller) abutted against the developing roller, and is then thinly applied on the developing roller by a toner regulating member. At the same time, toner particles are charged by friction with the toner regulating member and friction with the developing roller. Consequently, the developing roller is rotated while maintaining a certain nip width with the toner regulating member or the photosensitive drum, and the developing roller is therefore required to have a low hardness.

Furthermore, a tendency of demanding for an electrophotographic apparatus having a further reduced size and a high energy saving effect has been increased, and there is a tendency of using a low torque or using a roller having a reduced diameter as the toner supplying roller. However, a reduction in the diameter of the toner supplying roller or slowing the rotation speed for reducing the torque causes another problem of decreasing the amount of the toner conveyed to the developing roller.

As a method for increasing the amount of a toner conveyed to a developing roller, Japanese Patent Laid-Open No. 4-88381 proposes a developing method using a developing agent-bearing member having an elastic surface layer that is made of a conductive elastomer and contains insulating particles dispersed at least in the vicinity of the surface and partially exposed to the surface, and using a toner having a volume-average particle diameter not larger than one-third of the average particle diameter of the insulating particles exposing to the surface. Japanese Patent Laid-Open No. 5-072889 proposes a developing method using a developing agent-bearing member including a continuous phase (sea part) and a discontinuous phase (island part), at least in the surface, formed by blending two or more different amorphous polymers and molding the mixture.

SUMMARY

According to investigation by the present inventors, density unevenness was observed in some of electrophotographic images output by a printer including the developing roller or using the developing method described in Japanese Patent Laid-Open No. 4-88381 or 5-072889 under a low-temperature and low-humidity environment (for example, a temperature of 15° C. and a relative humidity of 10%). In addition, the image density gradually decreased in some cases when continuously outputting a large number of electrophotographic images under a low-temperature and low-humidity environment.

An aspect of the present disclosure is directed to providing a developing member that can stably form high-quality electrophotographic images even under a variety of environments, and a method of producing the developing member.

Another aspect of the present disclosure is directed to providing a process cartridge and an electrophotographic apparatus that may contribute to the formation of high-quality electrophotographic images. According to an aspect of the present disclosure, there is provided a developing member comprising a conductive substrate, a conductive elastic layer on the conductive substrate, and a plurality of insulating domains on the conductive elastic layer, wherein the developing member has a surface including one or more surfaces of the insulating domains, and an exposed portion of the conductive elastic layer not covered with the insulating domains, as well as the conductive elastic layer containing a resin and an anion, where the resin has a cationic structure including at least one structure represented by a formula selected from the following Formulae (1) to (7):

Formula (1)

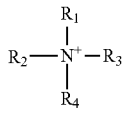

where $R_1$ to $R_4$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_1$ to $R_4$ represents a structure including a site binding to a polymer chain of the resin via an ether bond, an ester bond, or an urethane bond;

Formula (2)

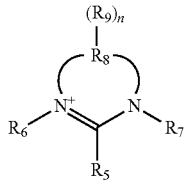

where $R_5$ to $R_7$ each independently represent a hydrogen atom, a monovalent hydrocarbon group having 1 to 30 carbon atoms, or a structure including a site binding to a polymer chain of the resin via an ether bond, an ester bond, or a urethane bond; $R_8$ represents a carbon chain constituting a 4- to 6-membered ring and optionally containing a heteroatom; n represents the number of $R_9$ that can bind to $R_8$ at the number of the ring members; and $(R_9)_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_5$ to $R_7$ and $(R_9)_n$ represents a structure including a site binding to a polymer chain of the resin via an ether bond, an ester bond, or an urethane bond; Formula (3)

Formula (3)

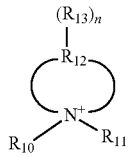

where $R_{10}$ and $R_{11}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{12}$ represents a carbon chain constituting a 4- to 6-membered ring and optionally containing an oxygen atom or a sulfur atom; n represents the number of $R_{13}$ that can bind to $R_{12}$ at the number of the ring members; and $(R_{13})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{10}$, $R_{11}$, and $(R_{13})_n$ represents a structure including a site binding to a polymer chain of the resin via an ether bond, an ester bond, or an urethane bond;

Formula (4)

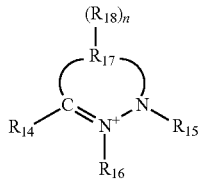

where $R_{14}$ to $R_{16}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{17}$ represents a carbon chain constituting a 4- to 6-membered ring and optionally containing a heteroatom; n represents the number of $R_{18}$ that can bind to $R_{17}$ at the number of the ring members; and $(R_{18})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{14}$ to $R_{16}$ and $(R_{18})_n$ represents a structure including a site binding to a polymer chain of the resin via an ether bond, an ester bond, or an urethane bond;

Formula (5)

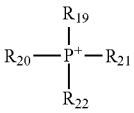

where $R_{19}$ to $R_{22}$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{19}$ to $R_{22}$ represents a structure including a site binding to a polymer chain of the resin via an ether bond, an ester bond, or an urethane bond;

Formula (6)

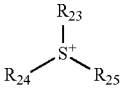

where $R_{23}$ to $R_{25}$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{23}$ to $R_{25}$ represents a structure including a site binding to a polymer chain of the resin via an ether bond, an ester bond, or an urethane bond; and Formula (7)

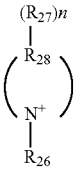

where $R_{26}$ represents a hydrogen atom, a monovalent hydrocarbon group having 1 to 30 carbon atoms, or a structure including a site binding to a polymer chain of the resin via an ether bond, an ester bond, or a urethane bond; $R_{28}$ represents a carbon chain constituting a 4- to 6-membered ring and optionally containing a heteroatom; n represents the number of $R_{27}$ that can bind to $R_{28}$ at the number of the ring members; and $(R_{27})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{26}$ and $(R_{27})_n$ represents a structure including a site binding to a polymer chain of the resin via an ether bond, an ester bond, or an urethane bond.

According to another aspect of the present disclosure, there is provided a process cartridge detachably attachable to the main body of an electrophotographic apparatus. The process cartridge comprises a developing unit including the developing member described above.

According to further aspect of the present disclosure, there is provided an electrophotographic apparatus comprising an image carrier for carrying an electrostatic latent image, a charging unit for charging the image carrier, an exposing unit for forming an electrostatic latent image on the charged image carrier, a developing unit for developing the electrostatic latent image with a toner to form a toner image, a transferring unit for transferring the toner image to a transfer material, and a fixing unit for fixing the toner image transferred on the transfer material. The developing unit includes the developing member described above.

According to still further aspect of the present disclosure, there is provided a method of producing a developing member. The method includes a step of forming a conductive elastic layer on a conductive substrate and a step of forming a plurality of insulating domains on the conductive elastic layer, wherein the developing member has a surface including the surfaces of the insulating domains and an exposed portion of the conductive elastic layer not covered with the insulating domains. The step of forming a conductive elastic layer includes a step of supplying a material containing at least a resin having a cationic structure and an anion for the conductive elastic layer onto the conductive substrate and curing the material. The resin is prepared by reacting an ion conductive agent composed of a cation represented by any of Formulae (11) to (17) having a reactive functional group and an anion to a compound having a functional group that can react to the reactive functional group:

Formula (11)

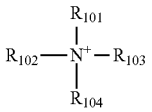

where $R_{101}$ to $R_{104}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{101}$ to $R_{104}$ represents a group having a reactive functional group that can bind to a polymer chain of the resin via an ether bond, an ester bond, or a urethane bond;

Formula (12)

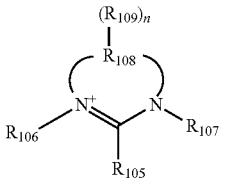

where $R_{105}$ to $R_{107}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{108}$ represents a carbon chain constituting a 4- to 6-membered ring and optionally containing a heteroatom; n represents the number of $R_{109}$ that can bind to $R_{108}$ at the number of the ring members; and $(R_{109})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{105}$ to $R_{107}$ and $(R_{109})_n$ represents a group having a reactive functional group that can bind to a polymer chain of the resin via an ether bond, an ester bond, or a urethane bond;

Formula (13)

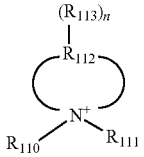

where $R_{110}$ and $R_{111}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{112}$ represents a carbon chain constituting a 4- to 6-membered ring and optionally containing an oxygen atom or a sulfur atom; n represents the number of $R_{113}$ that can bind to $R_{112}$ at the number of the ring members; and $(R_{113})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{110}$, $R_{111}$, and $(R_{113})_n$ represents a group having a reactive functional group that can bind to a polymer chain of the resin via an ether bond, an ester bond, or a urethane bond;

Formula (14)

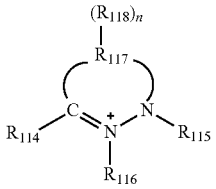

where $R_{114}$ to $R_{116}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{117}$ represents a carbon chain constituting a 4- to 6-membered ring and optionally containing a heteroatom; n represents the number of $R_{118}$ that can bind to $R_{117}$ at the number of the ring members; and $(R_{118})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{114}$ to $R_{116}$ and $(R_{118})_n$ represents a group having a reactive functional group that can bind to a polymer chain of the resin via an ether bond, an ester bond, or a urethane bond;

Formula (15)

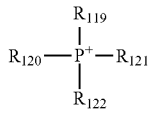

where $R_{119}$ to $R_{122}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{119}$ to $R_{122}$ represents a group having a reactive functional group that can bind to a polymer chain of the resin via an ether bond, an ester bond, or a urethane bond;

Formula (16)

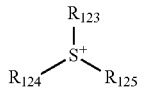

where $R_{123}$ to $R_{125}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{123}$ to $R_{125}$ represents a group having a reactive functional group that can bind to a polymer chain of the resin via an ether bond, an ester bond, or a urethane bond; and Formula (17)

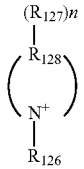

where $R_{126}$ represents a hydrogen atom, a monovalent hydrocarbon group having 1 to 30 carbon atoms, or a structure including a site binding to a polymer chain of the resin via an ether bond, an ester bond, or a urethane bond; $R_{128}$ represents a carbon chain constituting a 4- to 6-membered ring and optionally containing a heteroatom; n represents the number of $R_{127}$ that can bind to $R_{128}$ at the number of the ring members; and $(R_{127})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{126}$ and $(R_{127})_n$ represents a group having a reactive functional group that can bind to a polymer chain of the resin via an ether bond, an ester bond, or a urethane bond.

Further features of the present disclosure will become apparent from the following description of exemplary embodiments with reference to the attached drawings.

DESCRIPTION OF THE EMBODIMENTS

The developing member according to the present disclosure is composed of a conductive substrate and at least one conductive elastic layer formed on the conductive substrate (on the peripheral surface). Such a developing member is used as a roller-shaped developing member (hereinafter, referred to as developing roller) of the electrophotographic apparatus.

Figure 1A:
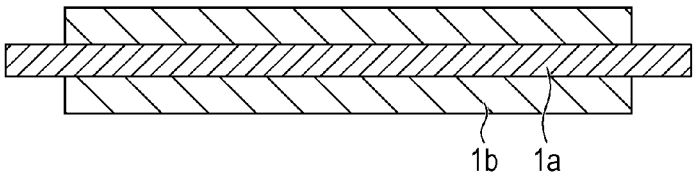
FIGS. 1A and 1B are cross-sectional views of a developing roller according to one or more aspect of the present disclosure.
Figure 1B:
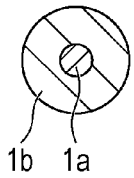

FIGS. 1A and 1B are cross-sectional views of an example of the developing member (developing roller) of the present disclosure. The developing roller includes a conductive substrate as the substrate and a conductive elastic layer.

Figure 2A:
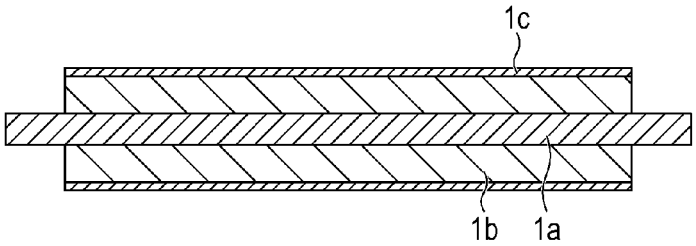
FIGS. 2A and 2B are cross-sectional views of a developing roller according to one or more aspect of the present disclosure.
Figure 2B:
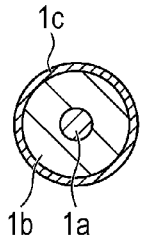

FIG. 1A is a cross-sectional view of the developing roller taken along a line parallel to the axial direction of the conductive substrate. FIG. 1B is a cross-sectional view of the developing roller taken along a line perpendicular to the axial direction of the conductive substrate. The developing roller 1 includes a conductive elastic layer 1*b* on the outer periphery of a conductive substrate 1*a*. The developing roller may further include another conductive elastic layer as a surface layer 1*c* on the surface of the conductive elastic layer 1*b*, as shown in FIGS. 2A and 2B.

(Conductive Elastic Layer)

In the present disclosure, insulating domains are scattered on the outermost surface of the conductive elastic layer, and the insulating domains and a part of the conductive elastic layer (hereinafter, also referred to as conductive portion) not covered with the insulating domains are present on the surface of the conductive elastic layer as exposure portions. The term "insulating domain" refers to a portion made of an insulating material having a volume resistivity of $1.0\times10^{13}$ Ω·cm or more, whereas the term "conductive portion" refers to a portion made of a conductive material having a volume resistivity of $1.0\times10^{12}$ Ω·cm or less. Addition of a conductive agent to the resin for the conductive elastic layer makes the resin electroconductive so that the resin acts as a conductive portion. Herein, the developing roller is required to be brought into pressure contact with the photosensitive drum or the toner regulating member at an appropriate area. The term "elasticity" refers to an appropriate softness as the developing roller. The roller having insulating domains and exposed conductive portion of the present disclosure can be produced by polishing a resin to which insulating particles are added in advance or by forming domains of an insulating material on a resin provided with conductivity.

The conductive elastic layer contains an anion and a resin including a polymer chain having at least one cationic structure represented by a formula selected from the following Formulae (1) to (7):

Formula (1)

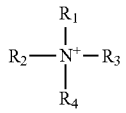

where $R_1$ to $R_4$ each independently represent a hydrogen atom, a monovalent hydrocarbon group having 1 to 30 carbon atoms, or a structure including a site binding to the resin via an ether bond, an ester bond, or a urethane bond, provided that at least one of $R_1$ to $R_4$ represents a structure including a site binding to the polymer chain of the resin via an ether bond, an ester bond, or an urethane bond;

Formula (2)

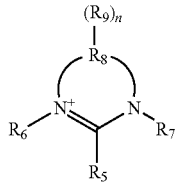

where $R_5$ to $R_7$ each independently represent a hydrogen atom, a monovalent hydrocarbon group having 1 to 30 carbon atoms, or a structure including a site binding to a polymer chain of the resin via an ether bond, an ester bond, or a urethane bond; $R_8$ represents a carbon chain constituting a 4- to 6-membered ring and optionally containing a heteroatom; n represents the number of $R_9$ that can bind to $R_8$ at the number of the ring members; and $(R_9)_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_5$ to $R_7$ and $(R_9)_n$ represents a structure including a site binding to a polymer chain of the resin via an ether bond, an ester bond, or an urethane bond, wherein $R_8$ can be an atomic group necessary for forming a nitrogen-containing 5- or 6-membered heterocycle together with two nitrogen atoms in Formula (2);

Formula (3)

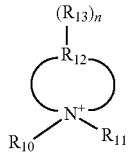

where $R_{10}$ and $R_{11}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{12}$ represents a carbon chain constituting a 4- to 6-membered ring and optionally containing an oxygen atom or a sulfur atom; n represents the number of $R_{13}$ that can bind to $R_{12}$ at the number of the ring members; and $(R_{13})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{10}$, $R_{11}$, and $(R_{13})_n$ represents a structure including a site binding to a polymer chain of the resin via an ether bond, an ester bond, or an urethane bond, wherein $R_{12}$ can be an atomic group necessary for forming a 5- or 6-membered heterocycle containing one nitrogen atom or one nitrogen atom and one oxygen atom in Formula (3);

Formula (4)

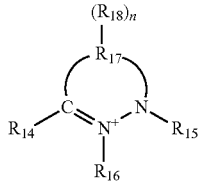

where $R_{14}$ to $R_{16}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{17}$ represents a carbon chain constituting a 4- to 6-membered ring and optionally containing a heteroatom; n represents the number of $R_{18}$ that can bind to $R_{17}$ at the number of the ring members; and $(R_{18})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{14}$ to $R_{16}$ and $(R_{18})_n$ represents a structure including a site binding to a polymer chain of the resin via an ether bond, an ester bond, or an urethane bond, wherein $R_{17}$ can be an atomic group necessary for forming a 5- or 6-membered heterocycle containing two nitrogen atoms in Formula (4);

Formula (5)

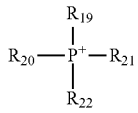

where $R_{19}$ to $R_{22}$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{19}$ to $R_{22}$ represents a structure including a site binding to a polymer chain of the resin via an ether bond, an ester bond, or an urethane bond;

Formula (6)

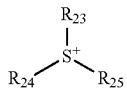

where $R_{23}$ to $R_{25}$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{23}$ to $R_{25}$ represents a structure including a site binding to a polymer chain of the resin via an ether bond, an ester bond, or an urethane bond;

Formula (7)

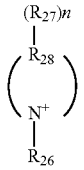

where $R_{26}$ represents a hydrogen atom, a monovalent hydrocarbon group having 1 to 30 carbon atoms, or a structure including a site binding to a polymer chain of the resin via an ether bond, an ester bond, or a urethane bond; $R_{28}$ represents a carbon chain constituting a 4- to 6-membered ring and optionally containing a heteroatom; n represents the number of $R_{27}$ that can bind to $R_{28}$ at the number of the ring members; and $(R_{27})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{26}$ and $(R_{27})_n$ represents a structure including a site binding to a polymer chain of the resin via an ether bond, an ester bond, or an urethane bond, wherein $R_{28}$ can be an atomic group necessary for forming a 5- or 6-membered heterocycle, in particular, a 6-membered aromatic heterocycle containing one or two nitrogen atoms in Formula (7).

Exposure of the insulating domains and a part of the conductive elastic layer (conductive portion) to the surface of a developing roller allows the developing roller to satisfactorily convey a toner. The reasons for this are as follows: Charge is accumulated in the insulating domains by triboelectrification between the developing roller and the toner or voltage application from the outside. On this occasion, a difference in potential is generated between the insulating domain and the conductive portion exposed to the surface of the developing roller. This potential difference forms a micro electric field to generate a gradient force. This gradient force occurs in the direction toward the center in a cross section perpendicular to the axial direction of the developing roller, and the developing roller attracts the toner by this gradient force. As a result, the developing roller rotates while attracting the toner to convey the toner on the photosensitive drum.

A printer including a developing roller that conveys a toner by means of such a gradient force, however, may form an image having density unevenness when used under a low-temperature and low-humidity environment.

The present inventors investigated the causes of the formation of images having density unevenness in the use of such a printer described above under a low-temperature and low-humidity environment, and found that the conductive elastic layer of the developing roller containing only an electron transfer conductive agent such as carbon black increases the electric resistance under a low temperature and a low humidity to readily manifest the influence of minute unevenness in the electric resistance. That is, the minute resistance unevenness in the conductive portion on the conductive elastic layer readily causes an uneven potential difference between the insulating domain and the conductive portion. As a result, unevenness readily occurs in the intensity of the generated electric field to cause a variation in the generated gradient force. It is therefore inferred that a variation is caused in the toner conveying amount to readily cause uneven density. Accordingly, the present inventors examined the use of a conductive elastic layer containing an ion conductive agent and thereby succeeded in prevention of image density unevenness under a low temperature and a low humidity. This is inferred that the ion conductive agent is uniformly present in the conductive elastic layer to reduce the electric resistance unevenness. However, the long-time use causes a phenomenon that the image density in the portion lastly output in one solid image is significantly lower compared to that in the portion first output or a phenomenon of causing image density unevenness. The causes of this are inferred that electrification causes uneven distribution of ions, increases the electric resistance of the conductive elastic layer, decreases the potential difference between the conductive portion and the insulating domain to weaken the electric field, decreases the generated gradient force, and decreases the amount of the toner to be conveyed; and causes minute resistance unevenness.

The present inventors accordingly introduced a cationic structure into the polymer chain of the resin contained in the conductive elastic layer to suppress the movement of ions involved in the expression of conductivity in the conductive elastic layer. At the same time, a cationic structure that can easily take in water, which is effective for enhancing the conductivity, was employed. This can suppress the change in the conductivity during electrification and allows the developing member to generate a uniform gradient force for a long time even under a low-temperature and low-humidity environment.

In $R_1$ to $R_4$ of Formula (1), $R_5$ to $R_7$ and $R_9$ of Formula (2), $R_{10}$, $R_{11}$, and $R_{13}$ of Formula (3), $R_{14}$ to $R_{16}$ and $R_{18}$ of Formula (4), $R_{19}$ to $R_{22}$ of Formula (5), $R_{23}$ to $R_{25}$ of Formula (6), and $R_{26}$ and $R_{27}$ of Formula (7), the monovalent hydrocarbon group having 1 to 30 carbon atoms is an alkyl group having 1 to 30 carbon atoms, such as a methyl group, an ethyl group, a propyl group, a butyl group, a pentyl group, a hexyl group, a heptyl group, or an octyl group; an aryl group having 6 to 30 carbon atoms, such as a phenyl group or a naphthyl group; or a combinations thereof.

In $R_1$ to $R_4$ of Formula (1), $R_5$ to $R_7$ and $R_9$ of Formula (2), $R_{10}$, $R_{11}$, and $R_{13}$ of Formula (3), $R_{14}$ to $R_{16}$ and $R_{18}$ of Formula (4), $R_{19}$ to $R_{22}$ of Formula (5), $R_{23}$ to $R_{25}$ of Formula (6), or $R_{26}$ and $R_{27}$ of Formula (7), the structure including a site binding to a polymer chain of a resin via an ether bond, an ester bond, or a urethane bond can include a hydrocarbon group having 3 or more carbon atoms at a site other than the site binding to the resin. Although the reasons therefor are not obvious, the presence of a hydrocarbon group having 3 or more carbon atoms appropriately suppresses the movement of ions to prevent electrification deterioration and to further prevent the reduction of density during a long time operation under a low temperature and a low humidity. The cationic structure can include three or more structures each including a site binding to a polymer chain of a resin via an ether bond, an ester bond, or a urethane bond.

Each of the ring structures represented by Formula (2) to (4) and (7) can be a stable 5- or 6-membered ring and may be an aliphatic ring or an aromatic ring. Examples of the ring structure represented by Formula (2) include 5-membered rings, such as an imidazole ring and an imidazoline ring.

Examples of the ring structure represented by Formula (3) include 4-membered rings, such as an azetidine ring; 5-membered rings, such as pyrrole ring; 6-membered rings, such as a piperidine ring; oxygen-containing rings, such as an oxazole ring and a morpholine ring; and sulfur-containing rings, such as a thiazole ring. Examples of the ring structure represented by Formula (4) include 5-membered rings, such as a pyrazole ring. Examples of the ring structure represented by Formula (7) include 6-membered rings, such as a pyridine ring.

Specific ring structures represented by Formulae (2) to (4) and (7) are shown below:

Formula (2-1)

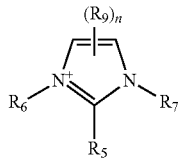

Formula (2-2)

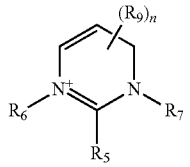

Formula (3-1)

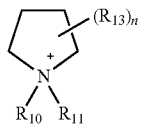

Formula (3-2)

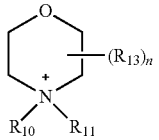

Formula (3-3)

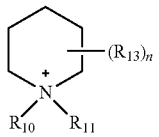

Formula (4-1)

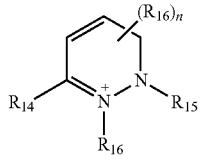

Formula (7-1)

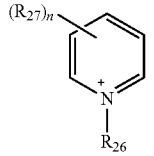

$R_5$ to $R_7$, $R_9$, and n in Formulae (2-1) and (2-2) are synonymous with those in Formula (2);

$R_{10}$, $R_{11}$, $R_{13}$, and n in Formulae (3-1) to (3-3) are synonymous with those in Formula (3);

$R_{14}$ to $R_{16}$, $R_{18}$, and n in Formula (4-1) are synonymous with those in Formula (4); and $R_{26}$, $R_{27}$, and n in Formula (7-1) are synonymous with those in Formula (7).

Each of the resins having cationic structures represented by Formulae (1) to (7) can be prepared as a reaction product of an ion conductive agent composed of a cation represented by any of Formulae (11) to (17) having a reactive functional group and an anion and a compound having a functional group that can react to the reactive functional group. Herein, the compound having a functional group that can react to the reactive functional group of the ion conductive agent can be a monomer, oligomer, prepolymer, or polymer as a raw material of the resin.

Formula (11)

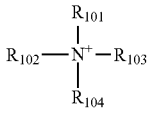

where $R_{101}$ to $R_{104}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{101}$ to $R_{104}$ represents a group having a reactive functional group that can bind to a polymer chain of the resin via an ether bond, an ester bond, or a urethane bond;

Formula (12)

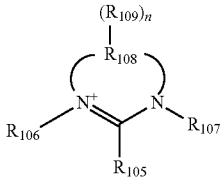

where $R_{105}$ to $R_{107}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{108}$ represents a carbon chain constituting a 4- to 6-membered ring and optionally containing a heteroatom; n represents the number of $R_{109}$ that can bind to $R_{108}$ at the number of the ring members; and $(R_{109})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{105}$ to $R_{107}$ and $(R_{109})_n$ represents a group having a reactive functional group that can bind to a polymer chain of the resin via an ether bond, an ester bond, or a urethane bond;

Formula (13)

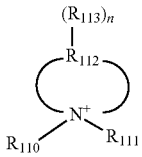

where $R_{110}$ and $R_{111}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{112}$ represents a carbon chain constituting a 4- to 6-membered ring and optionally containing an oxygen atom or a sulfur atom; n represents the number of $R_{113}$ that can bind to $R_{112}$ at the number of the ring members; and $(R_{113})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{110}$, $R_{111}$, and $(R_{113})_n$ represents a group having a reactive functional group that can bind to a polymer chain of the resin via an ether bond, an ester bond, or a urethane bond;

Formula (14)

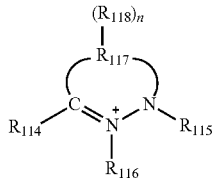

where $R_{114}$ to $R_{116}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{117}$ represents a carbon chain constituting a 4- to 6-membered ring and optionally containing a heteroatom; n represents the number of $R_{118}$ that can bind to $R_{117}$ at the number of the ring members; and $(R_{118})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{114}$ to $R_{116}$ and $(R_{118})_n$ represents a group having a reactive functional group that can bind to a polymer chain of the resin via an ether bond, an ester bond, or a urethane bond;

Formula (15)

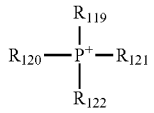

where $R_{119}$ to $R_{122}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{119}$ to $R_{122}$ represents a group having a reactive functional group that can bind to a polymer chain of the resin via an ether bond, an ester bond, or a urethane bond;

Formula (16)

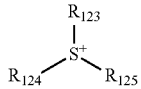

where $R_{123}$ to $R_{125}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{123}$ to $R_{125}$ represents a group having a reactive functional group that can bind to a polymer chain of the resin via an ether bond, an ester bond, or a urethane bond; and Formula (17)

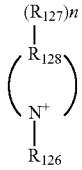

where $R_{126}$ represents a hydrogen atom, a monovalent hydrocarbon group having 1 to 30 carbon atoms, or a structure including a site binding to a polymer chain of the resin via an ether bond, an ester bond, or a urethane bond; $R_{128}$ represents a carbon chain constituting a 4- to 6-membered ring and optionally containing a heteroatom; n represents the number of $R_{127}$ that can bind to $R_{128}$ at the number of the ring members; and $(R_{127})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{126}$ and $(R_{127})_n$ represents a group having a reactive functional group that can bind to a polymer chain of the resin via an ether bond, an ester bond, or a urethane bond.

In the ion conductive agent having such a cationic structure, the reactive functional group that can bind to a polymer chain of the resin via an ether bond, an ester bond, or a urethane bond is, for example, a hydroxy group, an amino group, or a glycidyl group.

Examples of the compound that can react to the reactive functional group contained in the raw material of the resin include compounds having, in one molecule, two or more functional groups that can react to the reactive functional group. Examples of the functional group that can react to the reactive functional group include an isocyanate group, a carboxyl group, and an epoxy group.

Specifically, for example, if the reactive functional group is a hydroxy group, examples of compound that can react to the reactive functional group include isocyanate compounds, carboxylic acid compounds, epoxide compounds, and melamine compounds.

Examples of the isocyanate compound include aliphatic polyisocyanates, such as ethylene diisocyanate and 1,6-hexamethylene diisocyanate (HDI); alicyclic polyisocyanates, such as isophorone diisocyanate (IPDI), cyclohexane-1,3-diisocyanate, and cyclohexane-1,4-diisocyanate; aromatic isocyanates, such as 2,4-tolylene diisocyanate, 2,6-tolylene diisocyanate (TDI), 4,4'-diphenylmethane diisocyanate (MDI), polymeric diphenylmethane diisocyanate, xylylene diisocyanate, and naphthalene diisocyanate; and copolymers, isocyanurates, trimethylolpropane (TMP) adducts, and biurets thereof, and blocked such isocyanate compounds.

Examples of the carboxylic acid compound include aliphatic dicarboxylic acids, such as adipic acid, sebacic acid, malonic acid, 1,4-cyclohexanedicarboxylic acid, and hexahydroisophthalic acid; and aromatic dicarboxylic acids, such as orthophthalic acid, isophthalic acid, and terephthalic acid.

Examples of the epoxide compound include aliphatic diepoxides, such as 1,4-butanediol diglycidyl ether; and aromatic diepoxides, such as bisphenol A diglycidyl ether.

Examples of the melamine compound include methylated melamine, butylated melamine, imino melamine, methylbutyl mixed melamine, and methylol melamine.

When a resin is synthesized from an ion conductive agent and, as a raw material of the resin, a compound having a functional group that can react to the reactive functional group of the ion conductive agent, a monomer or prepolymer that reacts to the reactive compound may be used, in addition to the ion conductive agent, for further controlling the elastic coefficient of the conductive elastic layer.

For example, in a case of using a polyol as the prepolymer, examples of the polyol include polyether polyols and polyester polyols. Examples of the polyether polyol include polyethylene glycol, polypropylene glycol, and polytetramethylene glycol. Examples of the polyester polyol include diol components, such as 1,4-butanediol, 3-methyl-1,4-pentanediol, and neopentyl glycol; and polyester polyols prepared by a condensation reaction of a triol component, such as trimethylolpropane, and a dicarboxylic acid, such as adipic acid, phthalic anhydride, terephthalic acid, and hexahydroxyphthalic acid. The chains of the polyether polyol and the polyester polyol may be extended by an isocyanate, such as 2,4-tolylene diisocyanate (TDI), 1,4-diphenylmethane diisocyanate (MDI), or isophorone diisocyanate (IPDI), in advance as needed.

Specifically, the anion of the ion conductive agent, i.e., the anion contained in the conductive elastic layer is, for example, at least one selected from, for example, fluorosulfonate anions, fluorocarboxylate anions, fluorosulfonylimide anions, fluorosulfonylmethide anions, dicyanamide anions, fluoroalkylfluoroborate anions, fluorophosphate anions, fluoroantimonate anions, fluoroarsenate anions, and bis(oxalato)borate anions.

In the developing member according to the present disclosure, the conductive elastic layer contains such anions. As a consequence, density unevenness is further reduced, which is advantageous for preventing the decrease in density during image formation of a large number of sheets. This is inferred to be caused by that these anions are hydrophobic and have relatively low mobility as molecules.

Examples of the fluorosulfonate anion include a trifluoromethanesulfonate anion, a fluoromethanesulfonate anion, a perfluoroethylsulfonate anion, a perfluoropropylsulfonate anion, a perfluorobutylsulfonate anion, a perfluoropentylsulfonate anion, a perfluorohexylsulfonate anion, and a perfluorooctylsulfonate anion.

Examples of the fluorocarboxylate anion include a trifluoroacetate anion, a perfluoropropionate anion, a perfluorobutyrate anion, a perfluorovalerate anion, and a perfluorocaproate anion.

Examples of the fluorosulfonylimide anion include anions, such as a trifluoromethanesulfonylimide anion, a perfluoroethylsulfonylimide anion, a perfluoropropylsulfonylimide anion, a perfluorobutylsulfonylimide anion, a perfluoropentylsulfonylimide anion, a perfluorohexylsulfonylimide anion, a perfluorooctylsulfonylimide anion, and a fluorosulfonylimide anion; and cyclic anions, such as a cyclo-hexafluoropropane-1,3-bis(sulfonyl)imide anion.

Examples of the fluorosulfonylmethide anion include a trifluoromethanesulfonylmethide anion, a perfluoroethylsulfonylmethide anion, a perfluoropropylsulfonylmethide anion, a perfluorobutylsulfonylmethide anion, a perfluoropentylsulfonylmethide anion, a perfluorohexylsulfonylmethide anion, and a perfluorooctylsulfonylmethide anion.

Examples of the fluoroalkylfluoroborate anion include a trifluoromethyltrifluoroborate anion and a perfluoroethyltrifluoroborate anion.

Examples of the fluorophosphate anion include a hexafluorophosphate anion, a tris-trifluoromethyl-trifluorophosphate anion, and a tris-perfluoroethyltrifluorophosphate anion.

Examples of the fluoroantimonate anion include a hexafluoroantimonate anion and a trifluoromethyl-pentafluoroantimonate anion.

Examples of the fluoroarsenate anion include a hexafluoroarsenate anion and a trifluoromethyl-pentafluoroarsenate anion.

In the cation having a reactive functional group of the present disclosure, the reactive functional group can be a hydroxy group. Although the reasons therefor are not obvious, it is inferred that the cation is incorporated in the resin constituting the conductive elastic layer as a part thereof to further prevent the localization of the cation during electrification, and as a result, an increase in resistance and occurrence of minute resistance unevenness are prevented, leading to suppression of a decrease in density due to a decrease in gradient force and of density unevenness.

The hydroxy group binding to a heteroatom of the cationic moiety via a linking group or a cyclic skeleton containing the heteroatom (hereinafter, both are referred to as cationic skeleton) has relatively high reactivity. Examples of the linking group for binding the hydroxy group to the cationic skeleton include divalent hydrocarbon groups, alkylene ether groups, and combinations thereof. The substituent containing a hydroxy group via such a linking group may have a branched structure or may contain a plurality of hydroxy groups.

The divalent hydrocarbon group is a hydrocarbon group having 1 to 30 carbon atoms, such as a methylene group, an ethylene group, a propylene group, a butylene group, a pentylene group, a hexylene group, and a phenylene group. The divalent hydrocarbon group may include a heteroatom and may include another substituent (e.g., a monovalent hydrocarbon group having 1 to 30 carbon atoms; a halogen group, such as fluorine, chlorine, bromine, and iodine; an alkoxy group, such as a methoxy group and an ethoxy group; a substituent containing a heteroatom, such as an amide group and a cyano group; and a haloalkyl group, such as a trifluoromethyl group) in addition to the hydroxy group.

Examples of the alkylene ether group include alkylene ether groups having a degree of polymerization of 1 to 10, such as oligo(ethylene glycol), oligo(propyleneglycol), and oligo(tetramethylene glycol).

The substituent having a branched structure can have a carbon atom or a nitrogen atom as the branching point and include a plurality of hydroxy groups bound via a plurality of the linking groups mentioned above. Examples of the substituent include a 1,2-propanediol group, a [bis(2-hydroxyethyl)amino]ethylene group, and a 2,2-bis(hydroxymethyl)-3-hydroxypropyl group.

The cation according to the present disclosure can have three or more reactive functional groups. A cation having three or more reactive functional groups three-dimensionally crosslinks the resin and is thereby further prevented from moving and localizing. As a result, electrification deterioration is prevented to suppress an increase in resistance and occurrence of minute resistance unevenness. As a consequence, the gradient force can be prevented from decreasing, and a decrease in toner density can be suppressed.

The cation having a reactive functional group according to the present disclosure may include, in addition to a substituent including a hydroxy group, one or more substituents not including a hydroxy group (e.g., monovalent hydrocarbon group having 1 to 30 carbon atoms; a halogen group, such as fluorine, chlorine, bromine, and iodine; an alkoxy group, such as a methoxy group and an ethoxy group; a substituent containing a heteroatom, such as an amide group and a cyano group; and a haloalkyl group, such as a trifluoromethyl group).

The reactive compound according to the present disclosure can have at least one selected from an isocyanate group, a carboxy group, and an epoxy group. These functional groups of the reactive compound increase the reactivity to a cation having a reactive functional group according to the present disclosure and can prevent the cation in the conductive elastic layer from moving and localizing due to electrification to the developing roller, leading to prevention of the decrease in density.

Figure 3:
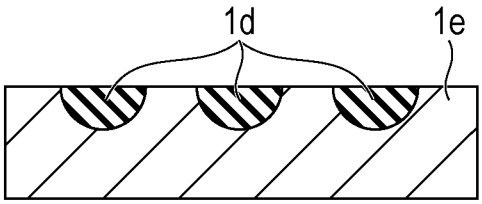
FIG. 3 is a cross-sectional view of a conductive elastic layer of a developing roller according to one or more aspect of the present disclosure.
Figure 4:
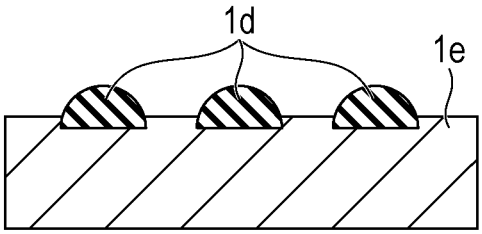
FIG. 4 is a cross-sectional view of a conductive elastic layer of a developing roller according to one or more aspect of the present disclosure.
Figure 5:
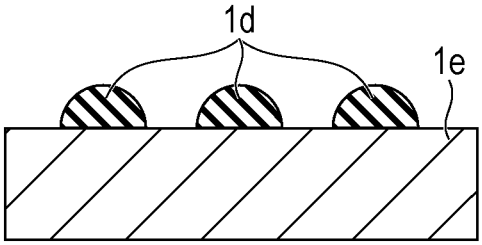
FIG. 5 is a cross-sectional view of a conductive elastic layer of a developing roller according to one or more aspect of the present disclosure.

In the present disclosure, the insulating domains and the conductive portion that generate a gradient force on the surface of the developing roller and attract and convey a toner may have any configuration. For example, the insulating domains 1*d* may be embedded in the conductive portion 1*e* as shown in FIG. 3, may be partially embedded in the conductive portion 1*e* as shown in FIG. 4, or may be present on the conductive portion 1*e* as shown in FIG. 5. In particular, the insulating domains can be convexly formed on the surface of the conductive elastic layer as shown in FIG. 4 or 5. The insulating domains 1*d* may have any shape and may have, for example, a spherical, cubic, or rectangular parallelepiped shape.

The insulating domains can have a size of 100 $\mu m^2$ or more and 100000 $\mu m^2$ or less. Within this range, an electric field is efficiently generated to increase the gradient force. The interval between the insulating domains can be 20 μm or more and 200 μm or less. Within this range of the interval between the domains, an electric field is efficiently generated to increase the gradient force.

The insulating domains can have a thickness of 3 μm or more. When the thickness is 3 μm or more, an electric field is readily generated to increase the gradient force.

The insulating domains according to the present disclosure may be exposed to the surface of the conductive elastic layer by any method that can provide a volume resistivity of $1.0\times10^{13}$ Ω·cm or more to the insulating domain portion. A volume resistivity of $1.0\times10^{13}$ Ω·cm or more allows a charge to be readily accumulated in the insulating domain to generate a micro electric field between the domain and the conductive portion. In an example of the method, insulating particles having a volume resistivity of $1.0\times10^{13}$ Ω·cm or more are added to the raw material for the conductive elastic layer containing the resin and anions; the resulting mixture is applied onto a conductive substrate and is then cured; and the surface of the resulting conductive elastic layer is polished to expose the island part as the insulating domain (dielectric portion) and the sea part as the conductive portion to the surface. Alternatively, an insulating material may be applied to a plurality of positions on the surface of the cured conductive elastic layer and may then be cured. Specifically, a plurality of concaves are formed on the surface of a conductive elastic layer, and an insulating material in a liquid state having a volume resistivity of $1.0\times10^{13}$ Ω·cm or more is poured into the concaves and is then cured to expose both the conductive elastic layer and the insulating material. Alternatively, an insulating material of which the cured product has a volume resistivity of $1.0\times10^{13}$ Ω·cm or more is applied onto a conductive elastic layer in a dot-like pattern by screen printing or a jet dispenser and is then cured to provide insulating domains.

When insulating particles are added as mentioned above, any insulating particles having a volume resistivity of $1.0\times10^{13}$ Ω·cm or more can be used. The use of insulating particles having a volume resistivity of $1.0\times10^{13}$ Ω·cm or more allows a charge to be readily accumulated in the insulating domain to generate a micro electric field between the domain and the conductive portion. Examples of the insulating particles include urethane resin particles, nylon resin particles, polyethylene resin particles, polyester resin particles, fluororesin particles, acrylic resin particles, silicone resin particles, polystyrene resin particles, and styrene-acrylic resin particles.

In the case of applying a dot-like pattern by screen printing or a jet dispenser, any coating solution that provides a volume resistivity of $1.0\times10^{13}$ Ω·cm or more after drying can be used. A volume resistivity of $1.0\times10^{13}$ Ω·cm or more allows a charge to be readily accumulated in the insulating domain to generate a micro electric field between the domain and the conductive portion. A coating solution containing a thermoplastic resin, a thermosetting resin, or a UV curable resin can be used without any limitation. Examples of such coating solution include a urethane resin coating solution, an acrylic resin coating solution, a polyethylene resin coating solution, a polypropylene resin coating solution, a polyester resin coating solution, a fluororesin coating solution, and an epoxy resin coating solution. These coating solutions may be diluted with a solvent before application, and any solvent can be used. Examples of the solvent include ketones, such as methyl ethyl ketone and methyl isobutyl ketone; hydrocarbons, such as hexane and toluene; alcohols, such as methanol and isopropanol; esters; and water. A coating solution containing a UV curable resin can be used from the viewpoint of easily controlling the size of the insulating domain.

In the case of using a UV curable resin, any UV curable resin that provides a volume resistivity of $1.0\times10^{13}$ Ω·cm or more after curing can be used. A volume resistivity of $1.0\times10^{13}$ Ω·cm or more allows a charge to be readily accumulated in the insulating domain to generate a micro electric field between the domain and the conductive portion. The UV curable resin can be a product by polymerization of a compound having an acryloyl group and/or a methacryloyl group. Examples of the compound having an acryloyl group and/or a methacryloyl group include monofunctional (meth)acrylates, such as 4-tert-butylcyclohexanol acrylate, stearyl acrylate, lauryl acrylate, 2-phenoxyethyl acrylate, isodecyl acrylate, isooctyl acrylate, isobonyl acrylate, and 4-ethoxylated nonylphenol acrylate; multifunctional monomers, such as 1,3-butyleneglycol diacrylate, 1,4-butanediol diacrylate, 1,6-hexanediol diacrylate, neopentyl glycol diacrylate, cyclohexane dimethanol diacrylate, ethoxylated bisphenol A diacrylate, tricyclodecane dimethanol diacrylate, trimethylolpropane triacrylate, pentaerythritol triacrylate, pentaerythritol tetraacrylate, and dipentaerythritol hexaacrylate; and polyurethane, polyester, polybutadiene, and epoxy resins containing terminal acryloyl or methacryloyl groups.

The compound having an acryloyl group and/or a methacryloyl group can be polymerized by being mixed with a polymerization initiator and irradiated with UV for curing. The polymerization initiator may be a known one. Examples of the initiator include 2,2-dimethoxy-1,2-diphenylethan-1-one, 1-hydroxycyclohexyl phenyl ketone, 2-hydroxy-2-methyl-1-phenylpropan-1-one, 1-[4-(2-hydroxyethoxy)-phenyl]-2-hydroxy-2-methyl-1-propan-1-one, 2-hydroxy-1-{4-[4-(2-hydroxy-2-methyl-propionyl)-benzyl]-phenyl}-2-methylpropan-1-one, 2-methyl-1-[4-(methylthio)phenyl]-2-morpholinopropan-1-one, 2-benzyl-2-dimethylamino-1-(4-morpholinophenyl)-butan-1-one, 2-dimethylamino-2-(4-methylbenzyl)-1-(4-morpholin-4-yl-phenyl)-butan-1-one, bis(2,4,6-trimethylbenzoyl)-phenylphosphine oxide, and 2,4,6-trimethylbenzoyl-diphenylphosphine oxide. These initiators may be used alone or in combination of two or more thereof.

The amount of the polymerization initiator can be 0.5 to 10 parts by mass based on 100 parts by mass of the total amount of the compound having an acryloyl group and/or a methacryloyl group. Within this amount of the polymerization initiator, the polymerization reaction can be efficiently carried out.

The UV light source for curing the UV curable resin may be a known one, such as an LED lamp, a high pressure mercury lamp, a metal halide lamp, and a xenon lamp. The necessary integral light quantity is appropriately determined depending on the type of the UV curable resin used and the type and the amount of the initiator used.

The insulating domains exposed to the surface of the developing roller of the present disclosure can be convexly formed on the surface of the conductive elastic layer. In such a case, the toner-conveying properties due to gradient force are enhanced, and the physical toner-conveying properties due to the convexes are also enhanced. The reduction in toner density during a long time operation under a low temperature and a low humidity can be thus further suppressed.

In the present disclosure, the dielectric portion and the conductive portion are exposed to the outermost surface of the developing member. The area ratio of the dielectric portion to the conductive portion (dielectric portion/conductive portion) can be 2/8 to 8/2. In this range, an electric field is efficiently generated to increase the gradient force to sufficiently secure the toner-conveying force.

The conductive elastic layer used in the present disclosure may further contain, as needed, an ordinary resin other than the resin according to the present disclosure, a compounding agent, a nonconductive filler, a crosslinking agent, and a catalyst, within a range that does not impair the advantageous effect of the present disclosure. Any ordinary resin may be used, and examples of the resin include epoxy resins, urethane resins, urea resins, ester resins, amide resins, imide resins, amide-imide resins, phenolic resins, vinyl resins, silicone resins, and fluororesins.

Examples of the compounding agent include fillers, softeners, processing aids, tackifiers, antitack agents, and foaming agents that are commonly used for resins. Examples of the nonconductive filler include silica, quartz powder, and calcium carbonate. Any crosslinking agent may be used, and examples thereof include tetraethoxy silane, di-t-butyl peroxide, 2,5-dimethyl-2,5-di(t-butylperoxy)hexane, and dicumyl peroxide.

The conductive elastic layer according to the present disclosure may contain a conductive agent, such as carbon black, in addition to the conductive agent of the present disclosure, without any limitation. Examples of the conductive agent include carbon black, such as acetylene black having a high conductivity; and furnace black, such as SAF, ISAF, HAF, MAF, FEF, GPF, and SRF. The conductive elastic layer can have a resistivity of $1.0\times10^{2}$ to $1.0\times10^{12}$ Ω·cm from the viewpoint of fog and ghost. Accordingly, the amount of the carbon black can be 80 parts by mass or less based on 100 parts by mass of the resin constituting the conductive elastic layer.

Furthermore, another conductive agent can be used together with the carbon black as needed. Examples of such additional conductive agent include conductive metals, such as graphite, aluminum, copper, tin, and stainless steel, and alloys thereof; and metal oxides, such as tin oxide, zinc oxide, indium oxide, titanium oxide, and tin oxide-antimony oxide solid solution, provided with conductivity. The developing roller can have a volume resistivity of $1.0\times10^{2}$ to $1.0\times10^{12}$ Ω·cm from the viewpoint of fog and ghost. The amount of the additional conductive agent can be 20 parts by mass or less based on 100 parts by mass of the resin constituting the conductive elastic layer.

Other various additives known in the art for the developing roller can be used. For example, reinforcing materials and heat transfer enhancers, such as hydrophilic silica, hydrophobic silica, quartz, calcium carbonate, aluminum oxide, zinc oxide, and titanium oxide, can be used.

The conductive elastic layer can be formed on the conductive substrate by any method known in the art for the developing roller. For example, a conductive substrate and a raw material for a conductive elastic layer are molded by coextrusion. In the case of using an elastic layer-forming material in a liquid form, a cylindrical pipe, plugs disposed on the both ends of the pipe for holding a conductive substrate, and the conductive substrate are arranged in a die; a raw material for a conductive elastic layer is injected in the die; and thermal curing is carried out.

In the present disclosure, as shown in FIGS. 2A and 2B, a surface layer 1*c* of a resin can be formed on a conductive elastic layer 1*b*. In this case, the surface layer 1*c* is formed such that insulating domains and a conductive portion are exposed. Although any known resin can be used as the resin for the surface layer, a resin synthesized from a compound that can react to the ion conductive agent can be particularly used. That is, in the present disclosure, the outermost surface (conductive portion) of the developing roller can be the resin according to the present disclosure. The outermost surface should have a predetermined conductivity for functioning as the conductive portion. In the case of forming a surface layer, the conductive elastic layer as the underlayer may be made of a known material other than the resin of the present disclosure. In this specification, the surface layer may be referred to as a conductive elastic layer.

The surface layer of the resin according to the present disclosure can be produced by, for example, applying a coating solution of the resin mixed with and dispersed in a solvent to the elastic layer.

The solvent for the coating solution can be appropriately used in the conditions that allow the resin used for the surface layer to be dissolved therein. Examples of the solvent include ketones, such as methyl ethyl ketone and methyl isobutyl ketone; hydrocarbons, such as hexane and toluene; alcohols, such as methanol and isopropanol; esters; and water. In particular, the solvent can be methyl ethyl ketone or methyl isobutyl ketone from the viewpoint of solubility of the resin and boiling point.

The layer of the resin according to the present disclosure as the surface layer can have a thickness of 4 μm or more and 50 μm or less, in particular, 5 μm or more and 45 μm or less. A thickness of 4 μm or more can prevent bleeding of the low-molecular weight component in the surface layer to prevent the contamination of the photosensitive drum and can prevent peeling of the surface layer. If the thickness is 50 μm or less, the developing roller has a high surface hardness, and the surface of the photosensitive drum is prevented from being scraped.

The surface layer can contain other additives, in addition to the carbon black and the ion conductive agent. Examples of the additives include spherical resin particles for providing roughness to the surface, reinforcing materials, surface conditioners, and charge control agents.

(Conductive Substrate)

Any conductive substrate that can function as a member supporting the electrode and the conductive elastic layer of the developing roller can be applied to the developing roller of the present disclosure, and a hollow or solid conductive substrate can be appropriately used. Examples of the material of the conductive substrate include metals, such as aluminum, copper, stainless steel, and iron, and alloys thereof; and conductive materials, such as conductive synthetic resins.

(Process Cartridge and Electrophotographic Apparatus)

The process cartridge according to the present disclosure is detachably attachable to the main body of an electrophotographic image forming apparatus. The process cartridge includes a developing unit including the developing member described above.

The electrophotographic apparatus according to the present disclosure is an image forming apparatus including an image carrier (photosensitive member) for carrying an electrostatic latent image, a charging unit for charging the image carrier, an exposing unit for forming an electrostatic latent image on the charged image carrier, a developing unit for developing the electrostatic latent image with a toner to form a toner image, a transferring unit for transferring the toner image to a transfer material, and a fixing unit for fixing the toner image transferred on the transfer material. The developing unit includes the developing member described above.

Figure 6:
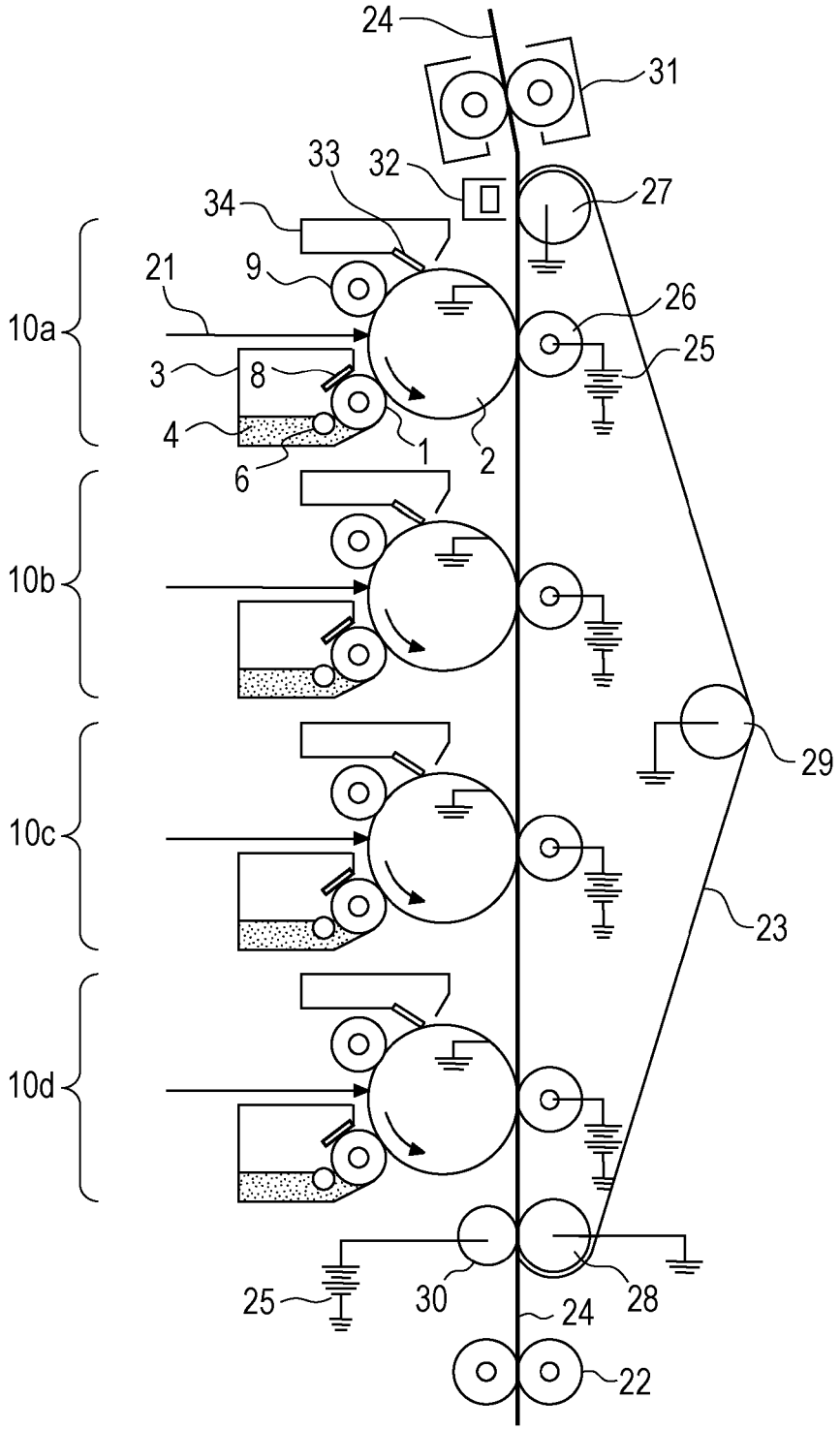
FIG. 6 is a schematic diagram illustrating an electrophotographic apparatus according to one or more aspect of the present disclosure.

FIG. 6 shows an example of the electrophotographic apparatus to which the developing member of the present disclosure can be applied. In this example, the developing member of the present disclosure is used as the developing roller 1. The color electrophotographic apparatus schematically illustrated in FIG. 6 includes process cartridges (10*a* to 10*d*) including developing units (for each color), respectively, for color toners, yellow Y, magenta M, cyan C, and black BK, in a tandem style. The process cartridges are detachably attachable to the main body of the electrophotographic apparatus.

The specification of each developing unit slightly differs depending on the color toner characteristics, but the fundamental structure is the same. The developing unit includes a photosensitive drum 2 that rotates in the arrow direction. In the periphery of the photosensitive drum 2, the apparatus includes a charging roller 9 for uniformly charging the photosensitive drum 2, an exposing device for irradiating the uniformly charged photosensitive drum 2 with laser light 21 to form an electrostatic latent image, and a hopper 3 for supplying a toner to the photosensitive drum 2 on which the electrostatic latent image is formed to develop the electrostatic latent image. Furthermore, the apparatus includes a transferring member for transferring the toner image on the photosensitive drum 2 onto a recording medium (transfer material) 24, such as paper, supplied by a paper feeding roller 22 and conveyed by a conveying belt 23. The transferring member includes a transferring roller 26 for applying a bias voltage to the back surface of the recording medium 24 from a bias power source 25.

The conveying belt 23 is suspended by a driving roller 27, a driven roller 28, and a tension roller 29 and is controlled so as to move in synchronization with an image forming unit and to transfer the recording medium 24 such that the toner image formed at each image-forming unit is sequentially superimposed and transferred onto the recording medium 24. The recording medium 24 is electrostatically adsorbed to the conveying belt 23 by means of an adsorption roller 30 disposed just before the conveying belt 23 and is thereby conveyed.

In the electrophotographic apparatus of FIG. 6, the photosensitive drum 2 and the developing roller 1 of the present disclosure are in contact with each other and are driven at the contacting point of the photosensitive drum 2 and the developing roller 1 to rotate in the same direction. Furthermore, this electrophotographic apparatus includes a fixing unit 31 for fixing the superimposed toner image transferred on the recording medium 24 by, for example, heating and a conveying unit (not shown) for discharging the recording medium having the image to the outside of the apparatus. The recording medium 24 is peeled from the conveying belt 23 by the work of a peeling unit 32 and is sent to the fixing unit 31. The developing unit includes a cleaning member having a cleaning blade 33 for removing the untransferred toner remaining on the photosensitive drum 2 without being transferred and a waste toner container 34 for receiving the toner scraped from the photosensitive member. The cleaned photosensitive drum 2 stands ready for forming another image.

Figure 7:
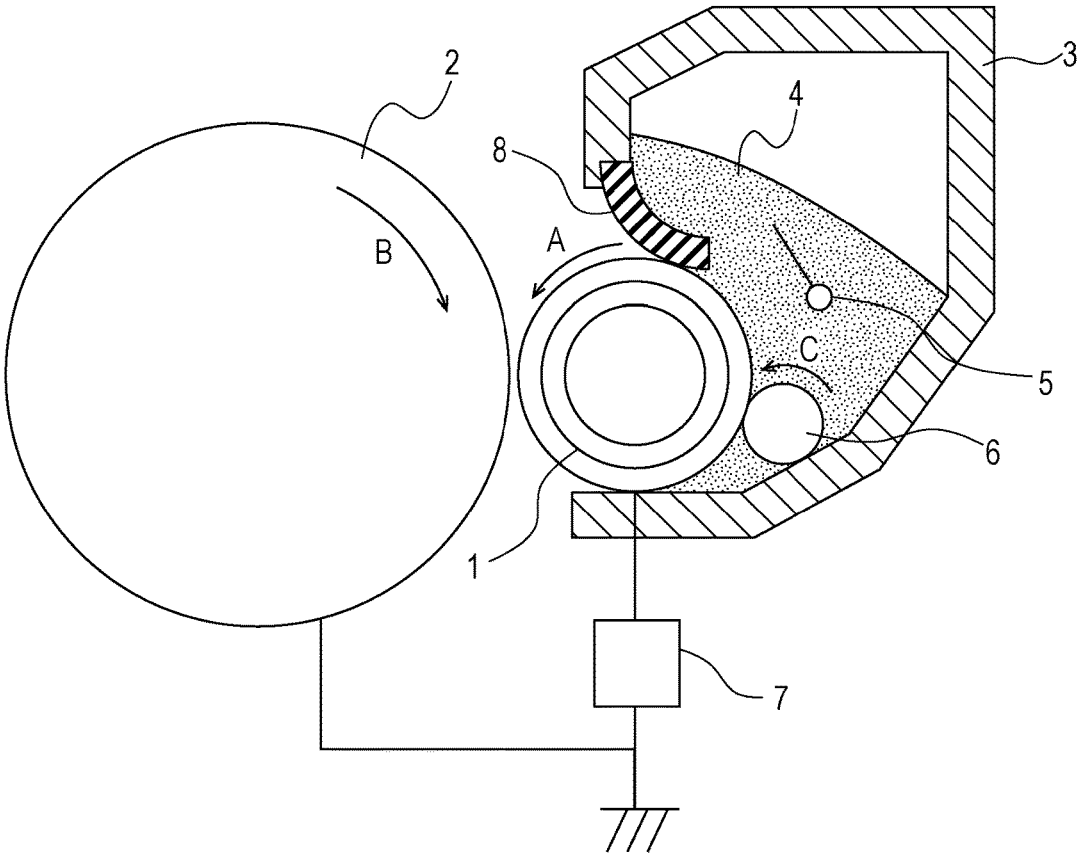
FIG. 7 is a schematic diagram illustrating a developing unit according to one or more aspect of the present disclosure.

FIG. 7 shows another example of the developing unit. In this developing unit, the photosensitive drum 2, which functions as the electrostatic latent image carrier carrying an electrostatic latent image formed through a known process, rotates in the arrow B direction. The hopper 3, which is a toner container, has a stirring blade 5 for stirring the non-magnetic mono-component toner 4. A member 6, which supplies a toner 4 to the developing roller 1 of the present disclosure and tears off the toner 4 present on the surface of the developing roller after developing, abuts against the developing roller. The roller as the toner supplying/tearing member 6 is rotated in the same direction (the arrow C direction) as the rotation direction (the arrow A direction) of the developing roller 1 for supplying and tearing off a toner on the surface. As a result, a non-magnetic mono-component toner including a non-magnetic toner supplied from the hopper 3 is supplied to the developing roller. A developing bias power source 7 applies a developing bias voltage to the developing roller 1 for transferring the toner 4 carried by the developing roller 1 to the photosensitive drum 2.

The toner supplying/tearing member 6 can be an elastic roller member, such as a resin, rubber, and sponge. The toner that has not been transferred to the photosensitive drum 2 in the development is temporarily torn off from the surface of the developing roller by the toner supplying/tearing member 6 to block the occurrence of immobile toner on the developing roller 1 and to uniformly charge the toner.

As a member for restricting the thickness of the toner 4 on the developing roller 1, a toner regulating member 8 of a material having rubber elasticity, such as urethane rubber and silicone rubber, or a material having metal elasticity, such as phosphor bronze and stainless steel, can be used. The toner regulating member 8 in a position reverse to the rotation direction (the arrow A direction) of the developing roller 1 is brought into pressure contact with the developing roller 1 to form a further thin toner layer on the developing roller 1.

EXAMPLES

The present disclosure will now be more specifically described by examples, but the disclosure is not limited to the following examples, and appropriate modification can be made within the scope of the present disclosure.

[Synthesis of Ion Conductive Agent 1]

A nucleophilic agent (dibutylamine: 25.9 g, manufactured by Tokyo Chemical Industry Co., Ltd.) was dissolved in acetonitrile (50 mL), and an electrophilic agent (2-bromoethanol: 62.5 g) was added thereto at room temperature, followed by reflux at 90° C. for 72 hours. Subsequently, the solvent was removed by distillation under reduced pressure. The residual substance was washed with diethyl ether, and the supernatant was removed by decantation. The procedure of the washing and decantation was repeated three times to obtain ion conductive agent 1 as the residual substance.

[Synthesis of Ion Conductive Agents 2 to 8]

Ion conductive agents 2 to 8 were synthesized as in the synthesis of ion conductive agent 1 using the nucleophilic agents, electrophilic agents, and anion exchangers shown in Table 1.

[Synthesis of Ion Conductive Agent 9]

Ion conductive agent 1 was dissolved in dichloromethane (30 mL), and a solution of lithium bis(trifluoromethanesulfonyl)imide (62.5 g, manufactured by Kanto Chemical Co., Ltd.) dissolved in water (30 mL)) was added as an anion exchanger to the solution, followed by stirring at room temperature for 24 hours. The resulting solution was subjected to liquid separation to obtain an organic layer. The organic layer was washed with water twice, and the dichloromethane was removed by distillation under reduced pressure to obtain ion conductive agent 9 of which the anion is the bis(trifluoromethanesulfonyl)imide anion.

[Synthesis of Ion Conductive Agents 10 to 27]

Ion conductive agents 10 to 27 were synthesized as in the synthesis of ion conductive agent 1 or 2 using the nucleophilic agents, electrophilic agents, and anion exchangers shown in Table 1.

TABLE 1

| Ion | Nucleophilic agent | | Electrophilic agent | | Anion exchanger | |
|---|---|---|---|---|---|---|
| conductive agent | Type | Amount (g) | Type | Amount (g) | Type | Amount (g) |
| 1 | Dibutylamine (Tokyo Chemical Industry Co., Ltd.) | 25.9 | 2-Bromoethanol (Tokyo Chemical Industry Co., Ltd.) | 62.5 | — | — |
| 2 | 2-Ethyl-4-methylimidazole (Tokyo Chemical Industry Co., Ltd.) | 32.6 | 2-Bromoethanol (Tokyo Chemical Industry Co., Ltd.) | 62.5 | — | — |
| 3 | 5-Ethyl-2-methylpyridine (Tokyo Chemical Industry Co., Ltd.) | 24.2 | 2-Bromoethanol (Tokyo Chemical Industry Co., Ltd.) | 62.5 | — | — |
| 4 | 1-Methyl-2-pyrrolidine ethanol (Tokyo Chemical Industry Co., Ltd.) | 25.8 | 2-Bromoethanol (Tokyo Chemical Industry Co., Ltd.) | 30.0 | — | — |
| 5 | 2-Methylpiperidine (Tokyo Chemical Industry Co., Ltd.) | 19.8 | 2-Bromoethanol (Tokyo Chemical Industry Co., Ltd.) | 62.5 | — | — |
| 6 | Morpholine (Tokyo Chemical Industry Co., Ltd.) | 17.4 | 2-Bromoethanol (Tokyo Chemical Industry Co., Ltd.) | 62.5 | — | — |
| 7 | Diethylphenyl phosphine (Tokyo Chemical Industry Co., Ltd.) | 33.2 | 2-Bromoethanol (Tokyo Chemical Industry Co., Ltd.) | 30.0 | — | — |
| 8 | 2-(Butylthio)ethanol (Tokyo Chemical Industry Co., Ltd.) | 26.8 | 2-Bromoethanol (Tokyo Chemical Industry Co., Ltd.) | 30.0 | — | — |
| 9 | Dibutylamine (Tokyo Chemical Industry Co., Ltd.) | 25.9 | 2-Bromoethanol (Tokyo Chemical Industry Co., Ltd.) | 62.5 | Lithium bis(trifluoromethane-sulfonyl)imide (Kanto Chemical Co., Ltd.) | 71.8 |
| 10 | 2-Ethyl-4-methylimidazole (Tokyo Chemical Industry Co., Ltd.) | 32.6 | 2-Bromoethanol (Tokyo Chemical Industry Co., Ltd.) | 62.5 | Lithium trifluoromethane-sulfonate (Wako Pure Chemical Industries, Ltd.) | 39.0 |
| 11 | Dibutylamine (Tokyo Chemical Industry Co., Ltd.) | 25.9 | 2-Bromoethanol (Tokyo Chemical Industry Co., Ltd.) | 62.5 | Lithium trifluoroacetate (Wako Pure Chemical Industries, Ltd.) | 34.0 |
| 12 | 2-Ethyl-4-methylimidazole (Tokyo Chemical Industry Co., Ltd.) | 32.6 | 2-Bromoethanol (Tokyo Chemical Industry Co., Ltd.) | 62.5 | Potassium tris(fluoromethane-sulfonyl)methide (trade name: K-TFSM, Central Glass Co., Ltd.) | 83.6 |
| 13 | Dibutylamine (Tokyo Chemical Industry Co., Ltd.) | 25.9 | 2-Bromoethanol (Tokyo Chemical Industry Co., Ltd.) | 62.5 | Sodium dicyanamide (Tokyo Chemical Industry Co., Ltd.) | 22.3 |

TABLE 1-continued

| Ion conductive agent | Nucleophilic agent Type | Amount (g) | Electrophilic agent Type | Amount (g) | Anion exchanger Type | Amount (g) |
|---|---|---|---|---|---|---|
| 14 | 2-Ethyl-4-methylimidazole (Tokyo Chemical Industry Co., Ltd.) | 32.6 | 2-Bromoethanol (Tokyo Chemical Industry Co., Ltd.) | 62.5 | Potassium trifluoro(trifluoromethyl)borate (Tokyo Chemical Industry Co., Ltd.) | 44.0 |
| 15 | Dibutylamine (Tokyo Chemical Industry Co., Ltd.) | 25.9 | 2-Bromoethanol (Tokyo Chemical Industry Co., Ltd.) | 62.5 | Lithium hexafluorophosphate (Wako Pure Chemical Industries, Ltd.) | 38.0 |
| 16 | 2-Ethyl-4-methylimidazole (Tokyo Chemical Industry Co., Ltd.) | 32.6 | 2-Bromoethanol (Tokyo Chemical Industry Co., Ltd.) | 62.5 | Lithium hexafluoroantimonate (Wako Pure Chemical Industries, Ltd.) | 67.7 |
| 17 | Dibutylamine (Tokyo Chemical Industry Co., Ltd.) | 25.9 | 2-Bromoethanol (Tokyo Chemical Industry Co., Ltd.) | 62.5 | Potassium hexafluoroarsenate (Tokyo Chemical Industry Co., Ltd.) | 45.6 |
| 18 | 2-Ethyl-4-methylimidazole (Tokyo Chemical Industry Co., Ltd.) | 32.6 | 2-Bromoethanol (Tokyo Chemical Industry Co., Ltd.) | 62.5 | Lithium bis(oxalato)borate (Tokyo Chemical Industry Co., Ltd.) | 48.4 |
| 19 | Triethanolamine (Tokyo Chemical Industry Co., Ltd.) | 29.8 | Iodomethane (Tokyo Chemical Industry Co., Ltd.) | 34.1 | Lithium bis(trifluoromethanesulfonyl)imide (Kanto Chemical Co., Ltd.) | 71.8 |
| 20 | 2-Butyl-5-hydroxymethylimidazole (Sigma Aldrich) | 30.8 | 2-Bromoethanol (Tokyo Chemical Industry Co., Ltd.) | 62.5 | Lithium bis(trifluoromethanesulfonyl)imide (Kanto Chemical Co., Ltd.) | 71.8 |
| 21 | Triethanolamine (Tokyo Chemical Industry Co., Ltd.) | 29.8 | Iodomethane (Tokyo Chemical Industry Co., Ltd.) | 34.1 | — | — |
| 22 | Tripropanolamine (Tokyo Chemical Industry Co., Ltd.) | 29.8 | Iodomethane (Tokyo Chemical Industry Co., Ltd.) | 34.1 | Lithium bis(trifluoromethanesulfonyl)imide (Kanto Chemical Co., Ltd.) | 71.8 |
| 23 | 2-Butyl-5-hydroxymethylimidazole (Sigma Aldrich) | 30.8 | 3-Bromo-1-propanol (Tokyo Chemical Industry Co., Ltd.) | 69.5 | Lithium bis(trifluoromethanesulfonyl)imide (Kanto Chemical Co., Ltd.) | 71.8 |
| 24 | Tripropanolamine (Tokyo Chemical Industry Co., Ltd.) | 29.8 | Iodomethane (Tokyo Chemical Industry Co., Ltd.) | 34.1 | — | — |
| 25 | 4-Ethylamino-1-butanol (Tokyo Chemical Industry Co., Ltd.) | 23.4 | 4-Bromo-1-butanol (Tokyo Chemical Industry Co., Ltd.) | 76.5 | Lithium bis(trifluoromethanesulfonyl)imide (Kanto Chemical Co., Ltd.) | 71.8 |
| 26 | Prolinol (Tokyo Chemical Industry Co., Ltd.) | 20.2 | 3-Bromo-1-propanol (Tokyo Chemical Industry Co., Ltd.) | 69.5 | Lithium bis(trifluoromethanesulfonyl)imide (Kanto Chemical Co., Ltd.) | 71.8 |
| 27 | 2-Piperidineethanol (Tokyo Chemical Industry Co., Ltd.) | 25.8 | 3-Bromo-1-propanol (Tokyo Chemical Industry Co., Ltd.) | 69.5 | Lithium bis(trifluoromethanesulfonyl)imide (Kanto Chemical Co., Ltd.) | 71.8 |

The formulae of the resulting ion conductive agents 1 to 27 are shown as Formulae (21) to (28) below, and substituents in the formulae are shown in Table 2.

Formula (21)

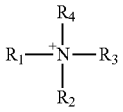

Formula (22)

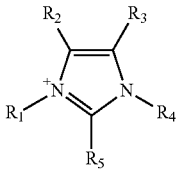

-continued

Formula (23)

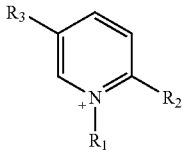

Formula (24)

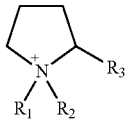

Formula (25)

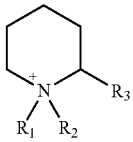

-continued

Formula (26)

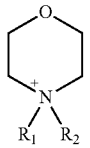

Formula (27)

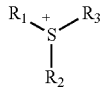

Formula (28)

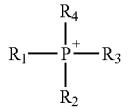

applied to the peripheral surface of the conductive substrate, followed by baking at 160° C. for 40 minutes.

Subsequently, the conductive substrate was coaxially placed in a cylindrical die. The gap between the inner peripheral surface of the die and the peripheral surface of the conductive substrate was filled with an elastic layer-forming liquid material in which the materials shown below were dispersed, followed by heating at 120° C. for 40 minutes. After the cooling, the conductive substrate was released from the die, and the conductive substrate was further heated at 200° C. in an oven for 4 hours to produce a roller member including an elastic layer having a thickness of 3 mm (hereinafter referred to as elastic layer roller).

Silicone rubber: XE15-645 A (solution) (trade name), Momentive Performance Materials Japan LLC, 50 parts by mass, Silicone rubber: XE15-645 B (solution) (trade name), Momentive Performance Materials Japan LLC, 50 parts by mass, and

TABLE 2

| Ion conductive agent | Formula | $R_1$ | $R_2$ | $R_3$ | $R_4$ | $R_5$ | Anion |
|---|---|---|---|---|---|---|---|
| 1 | (21) | $C_4H_9$ | $C_4H_9$ | $CH_2CH_2OH$ | $CH_2CH_2OH$ | — | $Br^-$ |
| 2 | (22) | $CH_2CH_2OH$ | $CH_3$ | H | $CH_2CH_2OH$ | $C_2H_5$ | $Br^-$ |
| 3 | (23) | $CH_2CH_2OH$ | $CH_3$ | $C_2H_5$ | — | — | $Br^-$ |
| 4 | (24) | $CH_2CH_2OH$ | $CH_3$ | $CH_2CH_2OH$ | — | — | $Br^-$ |
| 5 | (25) | $CH_2CH_2OH$ | $CH_2CH_2OH$ | $CH_3$ | — | — | $Br^-$ |
| 6 | (26) | $CH_2CH_2OH$ | $CH_2CH_2OH$ | — | — | — | $Br^-$ |
| 7 | (28) | $C_2H_5$ | $C_2H_5$ | $C_6H_5$ | $CH_2CH_2OH$ | — | $Br^-$ |
| 8 | (27) | $C_4H_9$ | $CH_2CH_2OH$ | $CH_2CH_2OH$ | — | — | $Br^-$ |
| 9 | (21) | $C_4H_9$ | $C_4H_9$ | $CH_2CH_2OH$ | $CH_2CH_2OH$ | — | $(CF_3SO_2)_2N^-$ |
| 10 | (22) | $CH_2CH_2OH$ | $CH_3$ | H | $CH_2CH_2OH$ | $C_2H_5$ | $CF_3SO_3^-$ |
| 11 | (21) | $C_4H_9$ | $C_4H_9$ | $CH_2CH_2OH$ | $CH_2CH_2OH$ | — | $CF_3CO_2^-$ |
| 12 | (22) | $CH_2CH_2OH$ | $CH_3$ | H | $CH_2CH_2OH$ | $C_2H_5$ | $(CF_3SO_2)_3C^-$ |
| 13 | (21) | $C_4H_9$ | $C_4H_9$ | $CH_2CH_2OH$ | $CH_2CH_2OH$ | — | $(CN)_2N^-$ |
| 14 | (22) | $CH_2CH_2OH$ | $CH_3$ | H | $CH_2CH_2OH$ | $C_2H_5$ | $CF_3BF_3^-$ |
| 15 | (21) | $C_4H_9$ | $C_4H_9$ | $CH_2CH_2OH$ | $CH_2CH_2OH$ | — | $PF_6^-$ |
| 16 | (22) | $CH_2CH_2OH$ | $CH_3$ | H | $CH_2CH_2OH$ | $C_2H_5$ | $SbF_6^-$ |
| 17 | (21) | $C_4H_9$ | $C_4H_9$ | $CH_2CH_2OH$ | $CH_2CH_2OH$ | — | $AsF_6^-$ |
| 18 | (22) | $CH_2CH_2OH$ | $CH_3$ | H | $CH_2CH_2OH$ | $C_2H_5$ | $C_4O_8B^-$ |
| 19 | (21) | $CH_2CH_2OH$ | $CH_2CH_2OH$ | $CH_2CH_2OH$ | $CH_3$ | — | $(CF_3SO_2)_2N^-$ |
| 20 | (22) | $CH_2CH_2OH$ | H | $CH_2OH$ | $CH_2CH_2OH$ | $C_4H_9$ | $(CF_3SO_2)_2N^-$ |
| 21 | (21) | $CH_2CH_2OH$ | $CH_2CH_2OH$ | $CH_2CH_2OH$ | $CH_3$ | — | $Br^-$ |
| 22 | (21) | $CH_2CH_2CH_2OH$ | $CH_2CH_2CH_2OH$ | $CH_2CH_2CH_2OH$ | $CH_3$ | — | $(CF_3SO_2)_2N^-$ |
| 23 | (22) | $CH_2CH_2CH_2OH$ | H | $CH_2OH$ | $CH_2CH_2CH_2OH$ | — | $(CF_3SO_2)_2N^-$ |
| 24 | (21) | $CH_2CH_2CH_2OH$ | $CH_2CH_2CH_2OH$ | $CH_2CH_2CH_2OH$ | $CH_3$ | — | $Br^-$ |
| 25 | (21) | $CH_2CH_2CH_2CH_2OH$ | $C_2H_5$ | $CH_2CH_2CH_2CH_2OH$ | $CH_2CH_2CH_2CH_2OH$ | — | $(CF_3SO_2)_2N^-$ |
| 26 | (24) | $CH_2CH_2CH_2OH$ | $CH_2CH_2CH_2OH$ | $CH_2OH$ | — | — | $(CF_3SO_2)_2N^-$ |
| 27 | (25) | $CH_2CH_2CH_2OH$ | $CH_2CH_2CH_2OH$ | $CH_2CH_2OH$ | — | — | $(CF_3SO_2)_2N^-$ |

[Synthesis of Prepolymer Having Terminal Isocyanate Group]

Polypropylene glycol polyol (PPG, 100 parts by mass, trade name: Sannix PP-1000, manufactured by Sanyo Chemical Industries, Ltd.) was gradually dropwise added to tolylene diisocyanate (TDI, 25 parts by mass, trade name: Cosmonate T80, manufactured by Mitsui Chemicals, Inc.) in a reaction container maintained at a temperature of 70° C. under a nitrogen atmosphere. After the completion of the dropping, the reaction was performed at 70° C. for 2 hours. The resulting reaction mixture was cooled to room temperature to obtain a prepolymer having a terminal isocyanate group at a content of 4.2%.

[Production of Developing Roller]

A stainless steel (SUS304) solid conductive substrate having a diameter of 6 mm and a total length of 280 mm was used as the conductive substrate. A silane coupling primer (trade name: DY35-051, Dow Corning Toray Co., Ltd.) was Carbon black: Denka Black (powder) (trade name), Denka Co., Ltd., 8 parts by mass.

[Developing Roller I]

A conductive elastic layer was formed on the peripheral surface of the elastic layer roller as follows:

a polyol (trade name: N5120, Nippon Polyurethane Industry Co., Ltd., 84 parts by mass), isocyanate (trade name: L-55E, Nippon Polyurethane Industry Co., Ltd., 16 parts by mass), carbon black (trade name: MA100, Mitsubishi Chemical Corporation, 5 parts by mass), an ion conductive agent (5 parts by mass), and acrylic resin particles (trade name: MX1500, Soken Chemical & Engineering Co., Ltd., average particle diameter: 15 μm (catalogue value), 30 parts by mass)

were weighed, and methyl ethyl ketone (MEK) was added to the mixture, followed by dispersion with a testing disperser (Paint Shaker, manufactured by Toyo Seiki Seisaku-Sho, Ltd.) to obtain a coating solution. The resulting coating solution was put in an overflow-type circulation coating apparatus. The elastic layer roller was dipped in the coating apparatus and then pulled up, followed by air drying for 30 minutes and then heating at 155° C. for 4 hours to form a coating film having a thickness of 7 μm. After cooling, the surface was polished with a rubber roll mirror finishing apparatus (trade name: SZC, manufactured by Minakuchi Machinery Works Ltd.) to form a developing roller I having a plurality of insulting domains derived from the acrylic resin particles and the conductive elastic layer exposed to the surface. The domains derived from the acrylic resin particles had a diameter of 15 μm.

The conductive elastic layer of another developing roller I than the developing roller I to be used for "Evaluation of developing roller" was cut out in the direction perpendicular to the longitudinal direction together with the elastic layer containing the silicone rubber on the substrate side, and the thickness of the conductive elastic layer was measured with an optical microscope. The results demonstrated that the thickness of the thickest portion of the conductive elastic layer, i.e., the portion where the surface of the conductive elastic layer constitutes the surface of the developing roller, was 7 μm.

[Developing Roller II]

A conductive elastic layer was formed on the peripheral surface of the elastic layer roller as follows:

a polyol (trade name: Preminol, Asahi Glass Co., Ltd., 60 parts by mass), a prepolymer having a terminal isocyanate group (40 parts by mass), a polyester resin (trade name: Vylon 200, Toyobo Co., Ltd., 20 parts by mass), carbon black (trade name: MA100, Mitsubishi Chemical Corporation, 5 parts by mass), and an ion conductive agent (5 parts by mass)

were weighed, and MEK was added to the mixture, followed by dispersion with a testing disperser (Paint Shaker, manufactured by Toyo Seiki Seisaku-Sho, Ltd.). The resulting mixture was put in an overflow-type circulation coating apparatus. The elastic layer roller was dipped in the coating apparatus and then pulled up, followed by air drying for 50 minutes and then heating at 140° C. for 6 hours. The surface of the roller was observed with an optical microscope (trade name: Laser microscope VK8710, manufactured by Keyence Corporation). A plurality of insulating domains derived from the polyester resin and a matrix of the conductive elastic layer were exposed to the surface. This roller was used as developing roller II. One domain had an area of 10000 $\mu m^2$. The thickest portion of the conductive elastic layer measured as in the "developing roller I" had a thickness of 10 μm.

[Developing Roller III]

A conductive elastic layer was formed on the peripheral surface of the elastic layer roller as follows:

a dicarboxylic acid (terephthalic acid, Tokyo Chemical Industry Co., Ltd., 65 parts by mass), an ion conductive agent (35 parts by mass), a polymerization catalyst (antimony trioxide, trade name: PATOX-C, Nihon Seiko Co., Ltd., 0.05 parts by mass), and acrylic resin particles (trade name: MX1500, Soken Chemical & Engineering Co., Ltd., average particle diameter: 15 μm (catalogue value), 30 parts by mass)

were weighed, and MEK was added to the mixture, followed by dispersion with a testing disperser (Paint Shaker, manufactured by Toyo Seiki Seisaku-Sho, Ltd.) to obtain a coating solution. The resulting coating solution was put in an overflow-type circulation coating apparatus. The elastic layer roller was dipped in the coating apparatus and then pulled up, followed by air drying for 30 minutes and then heating at 250° C. for 1 hour. After cooling, the surface was polished with a rubber roll mirror finishing apparatus (trade name: SZC, manufactured by Minakuchi Machinery Works Ltd.) to form a developing roller III having a plurality of insulting domains derived from the acrylic resin particles and the conductive elastic layer exposed to the surface. The domains derived from the acrylic resin particles had a diameter of 15 μm. The thickest portion of the conductive elastic layer measured as in the "developing roller I" had a thickness of 6 μm.

[Developing Roller IV]

A conductive elastic layer was formed on the peripheral surface of the elastic layer roller as follows:

an epoxy resin (trade name: 150, Mitsubishi Chemical Corporation, 90 parts by mass), a curing agent (trade name: 113, Mitsubishi Chemical Corporation, 10 parts by mass), carbon black (trade name: MA100, Mitsubishi Chemical Corporation, 5 parts by mass), an ion conductive agent (5 parts by mass), and acrylic resin particles (trade name: MX1500, Soken Chemical & Engineering Co., Ltd., average particle diameter: 15 μm (catalogue value), 30 parts by mass)

were weighed, and MEK was added to the mixture, followed by dispersion with a testing disperser (Paint Shaker, manufactured by Toyo Seiki Seisaku-Sho, Ltd.) to obtain a coating solution. The resulting coating solution was put in an overflow-type circulation coating apparatus. The elastic layer roller was dipped in the coating apparatus and then pulled up, followed by air drying for 30 minutes and then heating at 80° C. for 1 hour and further at 150° C. for 3 hours. After cooling, the surface was polished with a rubber roll mirror finishing apparatus (trade name: SZC, manufactured by Minakuchi Machinery Works Ltd.) to form a developing roller IV having a plurality of insulting domains derived from the acrylic resin particles and the conductive elastic layer exposed to the surface. The domains derived from the acrylic resin particles had a diameter of 15 μm. The surface layer measured as in the "developing roller I" had a thickness of 8 μm.

[Developing Roller V]

A conductive elastic layer was formed on the peripheral surface of the elastic layer roller as follows:

a melamine resin (trade name: 20SB, Mitsui Chemicals, Inc., 10 parts by mass), a polyester resin (trade name: Vylon 200, Toyobo Co., Ltd., 90 parts by mass), carbon black (trade name: MA100, Mitsubishi Chemical Corporation, 5 parts by mass), and an ion conductive agent (5 parts by mass)

were weighed, and MEK was added to the mixture, followed by dispersion with a testing disperser (Paint Shaker, manufactured by Toyo Seiki Seisaku-Sho, Ltd.) to obtain a coating solution. The resulting coating solution was put in an overflow-type circulation coating apparatus. The elastic layer roller was dipped in the coating apparatus and then pulled up, followed by air drying for 50 minutes and then heating at 150° C. for 5 hours. The surface of the roller was observed with an optical microscope (trade name: Laser microscope VK8710, manufactured by Keyence Corporation). A plurality of insulating domains derived from the polyester resin and a matrix of the conductive elastic layer were exposed to the surface. This roller was used as developing roller V. One domain had an area of 10000 $\mu m^2$. The surface layer measured as in the "developing roller I" had a thickness of 12 μm.

[Developing Roller VI]

Insulating domains (dielectric portion) were convexly formed on the peripheral surface of the developing roller as follows:

an acrylic compound (neopentyl glycol diacrylate, trade name: A-NPG, manufactured by Shin-Nakamura Chemical Co., Ltd., 100 parts by mass), and an initiator (1-hydroxy-cyclohexylphenyl ketone, trade name: IRGACURE 184, available from Toyotsu Chemiplas Corporation, 5 parts by mass)

were mixed, and the mixture was applied onto the peripheral surface of the developing roller I with a jet dispenser (trade name: NANO MASTER SMP-3, Musashi Engineering, Inc.).

Subsequently, the mixture-applied roller was set to a jig that can rotate the roller in the circumferential direction. The roller was irradiated with UV, while being rotated in the circumferential direction, using a high-pressure mercury lamp (trade name: Handy type UV Curing Device, manufactured by Mario Network) in an integral light quantity of 1200 mJ/$cm^2$ to cure the insulating domain. The resulting surface of the roller was observed with an optical microscope (trade name: Laser microscope VK8710, manufactured by Keyence Corporation). Convex dielectric insulating domains having a diameter of 84 μm at the bottom (the area contacting with the conductive elastic layer) were formed at intervals of 53 μm on the conductive portion, and a plurality of the insulating domains and the conductive portion were exposed. This roller was used as developing roller VI.

In the developing rollers I to VI, the polymer chain contained an ion conductive agent and had at least one structure selected from Formulae (7) to (14). This can be confirmed by analysis, such as pyrolysis GC/MS, evolved gas analysis (EGA-MS), FT-IR, or NMR. The conductive elastic layers prepared in this example were analyzed with a pyrolyzer (trade name: Pyrofoil Sampler JPS-700, manufactured by Japan Analytical Industry Co., Ltd.) and a GC/MS apparatus (trade name: Focus GC/ISQ, manufactured by Thermo Fisher Scientific, Inc.) at a thermal decomposition temperature of 590° C. using a helium carrier gas. As a result, the resulting fragment peaks demonstrated that the polymer chain of the resin contained a cationic structure.

Example 1

Developing roller I was produced using ion conductive agent 1 and was subjected to the evaluation of the developing roller, measurement of the value of current flowing in the developing roller, and evaluation of the electrification deterioration of the developing roller.

[Evaluation of Developing Roller]

[Preparation for Evaluation of Developing Roller]

The developing roller I was mounted on a remodeled process cartridge of a color laser printer (trade name: CLJ4525, manufactured by Hewlett-Packard Company) as the developing roller, and the process cartridge was mounted on the color laser printer and was left to stand under an environment of a temperature of 15° C. and a humidity of 10% for 48 hours. Subsequently, one sheet of a whole solid image was output under the same environment, and the following process was then repeated three times:

1. output of 10000 sheets of an image with a printing ratio of 0.3%; and
2. output of one sheet of a whole solid image.

[Image Density Unevenness of Solid Image]

The image densities of the output four sheets of the whole solid image were measured with a spectrodensitometer (trade name: X-Rite 504, S.D.G K.K.). Image densities at two points in the circumferential direction and seven points in the longitudinal direction, i.e., 14 points in total, were measured in the top portion of the image corresponding to one cycle of the roller. The densities at the 14 points were judged according to the following criteria A to E. The results are shown in Table 2. The image density of the solid image output in the process of the first time is referred to as "the image density in the first sheet", and the image density of the solid image output in the process of the Xth time is referred to as "the image density in the Xth sheet".

A: the difference in density in all of the first to fourth sheets is less than 0.1, B: the difference in density in the first to third sheets is less than 0.1, and the difference in density in the fourth sheet is 0.1 to 0.2, C: the difference in density in the first and second sheets is less than 0.1, and the difference in density in the third and fourth sheets is 0.1 to 0.2, D: the difference in density in the first sheet is less than 0.1, and the difference in density in the second to fourth sheets is 0.1 to 0.2, and E: the difference in density in any of the first to fourth sheets is higher than 0.2.

[Difference in Image Density Between Upper and Lower Portions of Solid Image]

The image densities of the resulting four sheets of the whole solid image were measured with a spectrodensitometer (trade name: X-Rite 504, S.D.G K.K.). Image densities at two points in the circumferential direction and seven points in the longitudinal direction, i.e., 14 points in total, were measured in the bottom portion of the image corresponding to one cycle of the roller, in addition to the measurement of densities in the "Image density unevenness of solid image" described above. The average value of the densities of the 14 points in the top portion and the average value of the densities of the 14 points in the bottom portion were judged according to the following criteria A to F. The results are shown in Table 3. The image density of the solid image output in the process of the first time is referred to as "the image density in the first sheet", and the image density of the solid image output in the process of the Xth time is referred to as "the image density in the Xth sheet".

A: the difference in density in all of the first to fourth sheets is less than 0.1, B: the difference in density in all of the first to fourth sheets is 0.1 or more and less than 0.2, C: the difference in density in the first to third sheets is less than 0.2, and the difference in density in the fourth sheet is 0.2 to 0.3, D: the difference in density in the first and second sheets is less than 0.2, and the difference in density in the third and fourth sheets is 0.2 to 0.3, E: the difference in density in the first sheet is less than 0.2, and the difference in density in the second to fourth sheets is 0.2 to 0.3, and F: the difference in density in any of the first to fourth sheets is higher than 0.3.

[Measurement of Resistance Unevenness of Developing Roller]

The current was measured with the apparatus shown in FIG. 8, and the resistance was calculated as follows. The developing roller 1 was brought into pressure contact with the aluminum drum 35. The aluminum drum 35 was rotated while applying a load of 4.9N to each end of the conductive substrate of the developing roller 1 to rotate the developing roller 1 at a rotation speed of 60 rpm, and a voltage of 50 V was then applied to the conductive substrate of the developing roller 1. The aluminum drum 35 was grounded through a reference resistance 36 having a resistance value of R(Ω). The potential differences between the both ends of the reference resistance were sampled with a potentiometer 37 at a speed of 200 times per second for five rotation cycles of the developing roller, and the resistance value of the developing roller was determined from the data of the five cycles. The current value I(A) was determined from the potential difference values X(V) of 1000 samples {data of (200 samples per second)×(5 seconds)} and the value R(f) according to the following expression:

$$\text{Current value } I(A)=X(V)/R(\Omega).$$

The resistance value Z(Ω) of the developing roller was calculated as follows:

$$Z(f)=50(V)/I(A)=50(V)/X(V)\times R(\Omega)).$$

The resistance unevenness was calculated from the maximum and minimum values of the resulting resistance values Z(Ω), and the results are shown in Table 3.

$$\text{Resistance Unevenness}=\text{Maximum Value } Z(f)/\text{Minimum Value } Z(\Omega).$$

The resistance unevenness of the developing roller was measured under an environment of a temperature of 15° C. and a humidity of 10% after being left under the same environment for 24 hours or more.

[Evaluation of Electrification Deterioration of Developing Roller]

Figure 8:
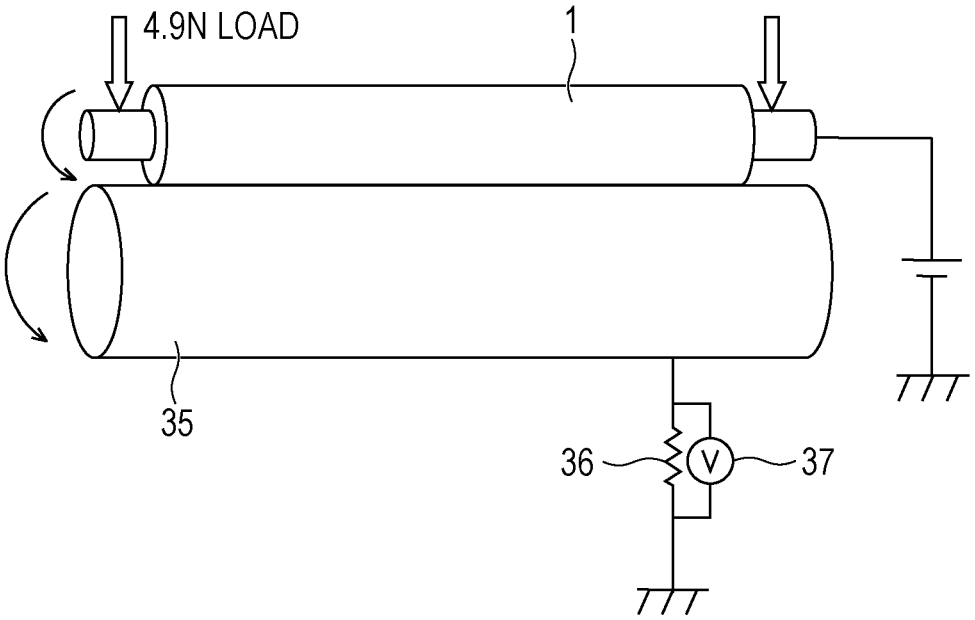
FIG. 8 is a schematic diagram illustrating an apparatus measuring the value of current flowing in a developing roller according to one or more aspect of the present disclosure.

A developing roller was brought into pressure contact with the aluminum drum 35 using the apparatus shown in FIG. 8. A load of 4.9N was applied to each end of the developing roller, and the drum 35 was in tight contact with the insulating resin of the developing roller. The aluminum drum 35 was rotated to rotate the developing roller at a rotation speed of 60 rpm. A voltage of 50 V was then applied to the conductive substrate of the developing roller, and the resistance value was determined. A voltage of 50 V was further applied for 6 hours while rotating the developing roller at 60 rpm. The resistance value was determined after the completion of the voltage application for 6 hours, and the rate of change in the resistance value was calculated as follows. The results are shown in Table 2.

$$\text{Rate of change in resistance value}=\text{resistance value after voltage application for 6 hours/resistance value at initial voltage application.}$$

Subsequently, the resistance was measured by the same method as that described in the "Measurement of resistance unevenness of developing roller", and the resistance unevenness of the developing roller after electrification was determined. The results are shown in Table 3. The electrification deterioration of the developing roller was evaluated under an environment of a temperature of 15° C. and a humidity of 10% after being left under the same environment for 24 hours or more.

Examples 2 to 32

Examples 2 to 32 were carried out as in Example 1 except that the ion conductive agents and the developing rollers shown in Table 3 were used. The results are shown in Table 3.

Comparative Example 1

Comparative Example 1 was carried out as in Example 1 except that no ion conductive agent was used. The results are shown in Table 3.

Comparative Example 2

Comparative Example 2 was carried out as in Example 1 except that ethyldimethylpropylammonium bis(trifluoromethylsulfonyl)imide (manufactured by Aldrich) was used as the ion conductive agent. The results are shown in Table 3.

Comparative Example 3

Comparative Example 3 was carried out as in Example 1 except that 1-butyl-3-methylimidazolium bis(trifluoromethylsulfonyl)imide (manufactured by Aldrich) was used as the ion conductive agent. The results are shown in Table 3.

Comparative Example 4

Comparative Example 4 was carried out as in Example 1 except that a polyester resin (trade name: Plas-Coat Z-880, GOO Chemical Co., Ltd., containing —$SO_3Na$, 100 parts by mass) was used instead of the polyol and the isocyanate, Lion Paste W-311N (trade name, Lion Corporation) was used as the carbon black, water was used instead of MEK, and no ion conductive agent was used. The results are shown in Table 3.

TABLE 3

| | | Ion conductive agent | Type of cation | Reactive functional group Number | Reactive functional group Type | Type of anion | Functional group of reactive compound | Number of carbon atoms between reactive functional group and cation |
|---|---|---|---|---|---|---|---|---|
| Example | 1 | 1 | Ammonium | 2 | Hydroxy group | Bromide | Isocyanate group | 2 |
| | 2 | 2 | Imidazolium | 2 | Hydroxy group | Bromide | Isocyanate group | 2 |
| | 3 | 3 | Pyridinium | 1 | Hydroxy group | Bromide | Isocyanate group | 2 |
| | 4 | 4 | Pyrrolidium | 2 | Hydroxy group | Bromide | Isocyanate group | 2 |
| | 5 | 5 | Piperidium | 2 | Hydroxy group | Bromide | Isocyanate group | 2 |
| | 6 | 6 | Morpholinium | 1 | Hydroxy | Bromide | Isocyanate | 2 |

TABLE 3-continued

| | | | | | | | | |
|---|---|---|---|---|---|---|---|---|
| | | | | | group | | group | |
| | 7 | 7 | Phosphonium | 1 | Hydroxy group | Bromide | Isocyanate group | 2 |
| | 8 | 8 | Sulfonium | 2 | Hydroxy group | Bromide | Isocyanate group | 2 |
| | 9 | 1 | Ammonium | 2 | Hydroxy group | Bromide | Carboxyl group | 2 |
| | 10 | 1 | Ammonium | 2 | Hydroxy group | Bromide | Epoxy group | 2 |
| | 11 | 1 | Ammonium | 2 | Hydroxy group | Bromide | Alkoxy group | 2 |
| | 12 | 9 | Ammonium | 2 | Hydroxy group | Fluorosulfonylimide | Isocyanate group | 2 |
| | 13 | 10 | Imidazolium | 2 | Hydroxy group | Fluorosulfonate | Isocyanate group | 2 |
| | 14 | 11 | Ammonium | 2 | Hydroxy group | Fluorocarboxylate | Isocyanate group | 2 |
| | 15 | 12 | Imidazolium | 2 | Hydroxy group | Fluorosulfonylmethide | Isocyanate group | 2 |
| | 16 | 13 | Ammonium | 2 | Hydroxy group | Dicyanamide | Isocyanate group | 2 |
| | 17 | 14 | Imidazolium | 2 | Hydroxy group | Fluoroalkylfluoroborate | Isocyanate group | 2 |
| | 18 | 15 | Ammonium | 2 | Hydroxy group | Fluorophosphate | Isocyanate group | 2 |
| | 19 | 16 | Imidazolium | 2 | Hydroxy group | Fluoroantimonate | Isocyanate group | 2 |
| | 20 | 17 | Ammonium | 2 | Hydroxy group | Fluoroarsenate | Isocyanate group | 2 |
| | 21 | 18 | Imidazolium | 2 | Hydroxy group | Bis(oxalato)borate | Isocyanate group | 2 |
| | 22 | 19 | Ammonium | 3 | Hydroxy group | Fluorosulfonylimide | Isocyanate group | 2 |
| | 23 | 20 | Imidazolium | 3 | Hydroxy group | Fluorosulfonylimide | Isocyanate group | 2 |
| | 24 | 21 | Ammonium | 3 | Hydroxy group | Bromide | Isocyanate group | 2 |
| | 25 | 22 | Ammonium | 3 | Hydroxy group | Fluorosulfonylimide | Isocyanate group | 3 |
| | 26 | 23 | Imidazolium | 3 | Hydroxy group | Fluorosulfonylimide | Isocyanate group | 3 |
| | 27 | 24 | Ammonium | 3 | Hydroxy group | Bromide | Isocyanate group | 3 |
| | 28 | 25 | Ammonium | 3 | Hydroxy group | Fluorosulfonylimide | Isocyanate group | 4 |
| | 29 | 22 | Ammonium | 3 | Hydroxy group | Fluorosulfonylimide | Isocyanate group | 3 |
| | 30 | 23 | Imidazolium | 3 | Hydroxy group | Fluorosulfonylimide | Isocyanate group | 3 |
| | 31 | 26 | Pyrrolidium | 3 | Hydroxy group | Fluorosulfonylimide | Isocyanate group | 3 |
| | 32 | 27 | Piperidium | 3 | Hydroxy group | Fluorosulfonylimide | Isocyanate group | 3 |
| Comparative Example | 1 | — | | | | CB alone | | |
| | 2 | — | Ammonium | | None | Fluorosulfonylimide | None | None |
| | 3 | — | Imidazolium | | None | Fluorosulfonylimide | None | None |
| | 4 | — | | Metal ion | | Sulfonate (fixed type) | — | — |

| | | Developing roller | Electric characteristics: Initial resistance unevenness | Electrification deterioration | Resistance unevenness after electrification | Evaluation rank: Density unevenness | Top-bottom density difference |
|---|---|---|---|---|---|---|---|
| Example | 1 | I | 7.3 | 0.39 | 8.4 | D | E |
| | 2 | II | 7.6 | 0.37 | 8.7 | D | E |
| | 3 | I | 7.4 | 0.36 | 8.5 | D | E |
| | 4 | II | 7.3 | 0.35 | 8.2 | D | E |
| | 5 | I | 7.1 | 0.36 | 8.3 | D | E |
| | 6 | II | 7.9 | 0.37 | 8.8 | D | E |
| | 7 | I | 7.3 | 0.38 | 8.6 | D | E |
| | 8 | II | 7.4 | 0.35 | 8.6 | D | E |
| | 9 | III | 7.6 | 0.37 | 8.4 | D | E |
| | 10 | IV | 7.5 | 0.36 | 8.7 | D | E |
| | 11 | V | 7.2 | 0.39 | 8.3 | D | E |
| | 12 | I | 6.1 | 0.44 | 7.3 | C | D |
| | 13 | II | 6.5 | 0.42 | 7.5 | C | D |
| | 14 | I | 6.3 | 0.43 | 7.1 | C | D |
| | 15 | II | 6.1 | 0.44 | 7.6 | C | D |

TABLE 3-continued

| | | | | | | | |
|---|---|---|---|---|---|---|---|
| | 16 | I | 6.8 | 0.41 | 7.7 | C | D |
| | 17 | II | 6.4 | 0.42 | 7.5 | C | D |
| | 18 | I | 6.3 | 0.4 | 7.6 | C | D |
| | 19 | II | 6.4 | 0.41 | 7.4 | C | D |
| | 20 | I | 6.9 | 0.44 | 7.9 | C | D |
| | 21 | II | 6.7 | 0.42 | 7.8 | C | D |
| | 22 | I | 5.3 | 0.48 | 6.5 | B | C |
| | 23 | II | 5.1 | 0.46 | 6.7 | B | C |
| | 24 | I | 6.2 | 0.43 | 7.3 | C | D |
| | 25 | II | 4.6 | 0.54 | 5.9 | A | B |
| | 26 | I | 4.3 | 0.52 | 5.7 | A | B |
| | 27 | II | 5.5 | 0.48 | 6.6 | B | C |
| | 28 | I | 4.2 | 0.51 | 5.6 | A | A |
| | 29 | VI | 4.5 | 0.56 | 5.8 | A | A |
| | 30 | VI | 4.1 | 0.52 | 5.7 | A | A |
| | 31 | VI | 4.1 | 0.55 | 5.4 | A | A |
| | 32 | VI | 4.3 | 0.51 | 5.3 | A | A |
| Comparative Example | 1 | I | 12.3 | 0.31 | 15.1 | E | F |
| | 2 | I | 5.6 | 0.15 | 14.6 | E | F |
| | 3 | I | 5.4 | 0.12 | 15.3 | E | F |
| | 4 | I | 8.1 | 0.33 | 9.7 | E | F |

In Examples 1 to 11, ion conductive agents each including any of ammonium cations, imidazolium cations, pyridinium cations, pyrrolidium cations, piperidium cations, morpholinium cations, phosphonium cations, and sulfonium cations and each having at least one reactive functional group were used. As a result, resistance unevenness and electrification deterioration were suppressed to reduce the image density unevenness during paper feeding and to reduce a decrease in density at the lower portion of a solid image. In Examples 12 to 21, anions other than those used in Examples 1 to 11 were used. As a result, image density unevenness during paper feeding and a reduction in density at the lower portion of a solid image were further suppressed. In Examples 22 to 24, the number of the reactive functional groups was changed to three from one or two. As a result, resistance unevenness and electrification deterioration were further suppressed to reduce the image density unevenness during paper feeding and to reduce a decrease in density at the lower portion of a solid image. In Examples 25 to 28, the number of carbon atoms present between the reactive functional group and the cationic group was three or more. As a result, image density unevenness during paper feeding and a reduction in density at the lower portion of a solid image were further suppressed. In Examples 29 to 33, insulating domains were formed on the conductive elastic layer. As a result, a reduction in density at the lower portion of a solid image was particularly suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-224315 filed Nov. 16, 2015, which is hereby incorporated by reference herein in its entirety.

What is claimed is:

1. A developing member comprising:

a conductive substrate;

a conductive elastic layer on the conductive substrate; and a plurality of insulating domains on the conductive elastic layer, wherein the developing member has a surface including:

at least one surface of the insulating domains; and an exposed portion of the conductive elastic layer not covered with the insulating domains, and the conductive elastic layer contains a resin and an anion, wherein the resin has a cationic structure including at least one structure represented by a formula selected from the following Formulae (1) to (7):

Formula (1)

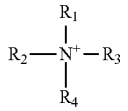

[where $R_1$ to $R_4$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_1$ to $R_4$ represents a structure including a site binding to a polymer chain of the resin via an ether bond, an ester bond, or an urethane bond];

Formula (2)

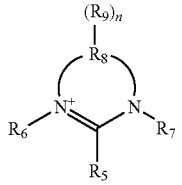

[where $R_5$ to $R_7$ each independently represent a hydrogen atom, a monovalent hydrocarbon group having 1 to 30 carbon atoms, or a structure including a site binding to a polymer chain of the resin via an ether bond, an ester bond, or a urethane bond; $R_8$ represents a carbon chain constituting a 4- to 6-membered ring and optionally containing a heteroatom; n represents the number of $R_9$ that can bind to $R_8$ at the number of the ring members; and $(R_9)_n$ each independently represent a hydrogen atom, a monovalent hydrocarbon group having 1 to 30 carbon atoms, or a structure including a site binding to the resin via an ether bond, an ester bond, or a urethane bond, provided that at least one of $R_5$ to $R_7$ and $(R_9)_n$ represents a structure including a site binding to a polymer chain of the resin via an ether bond, an ester bond, or an urethane bond];

Formula (3)

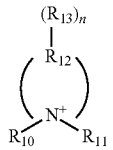

[where $R_{10}$ and $R_{11}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{12}$ represents a carbon chain constituting a 4- to 6-membered ring and optionally containing an oxygen atom or a sulfur atom; n represents the number of $R_{13}$ that can bind to $R_{12}$ at the number of the ring members; and $(R_{13})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{10}$, $R_{11}$, and $(R_{13})_n$ represents a structure including a site binding to a polymer chain of the resin via an ether bond, an ester bond, or an urethane bond];

Formula (4)

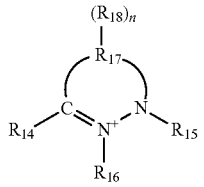

[where $R_{14}$ to $R_{16}$ each independently represent a hydrogen atom, a monovalent hydrocarbon group having 1 to 30 carbon atoms, or a structure including a site binding to a polymer chain of the resin via an ether bond, an ester bond, or a urethane bond; $R_{17}$ represents a carbon chain constituting a 4- to 6-membered ring and optionally containing a heteroatom; n represents the number of $R_{18}$ that can bind to $R_{17}$ at the number of the ring members; and $(R_{18})_n$ each independently represent a hydrogen atom, a monovalent hydrocarbon group having 1 to 30 carbon atoms, or a structure including a site binding to the resin via an ether bond, an ester bond, or a urethane bond, provided that at least one of $R_{14}$ to $R_{16}$ and $(R_{18})_n$ represents a structure including a site binding to a polymer chain of the resin via an ether bond, an ester bond, or an urethane bond];

Formula (5)

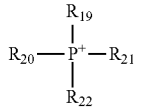

[where $R_{19}$ to $R_{22}$ each independently represent a hydrogen atom, a monovalent hydrocarbon group having 1 to 30 carbon atoms, or a structure including a site binding to a polymer chain of the resin via an ether bond, an ester bond, or an urethane bond, provided that at least one of $R_{19}$ to $R_{22}$ represents a structure including a site binding to a polymer chain of the resin via an ether bond, an ester bond, or an urethane bond];

Formula (6)

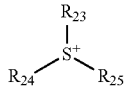

[where $R_{23}$ to $R_{25}$ each independently represent a hydrogen atom, a monovalent hydrocarbon group having 1 to 30 carbon atoms, or a structure including a site binding to a polymer chain of the resin via an ether bond, an ester bond, or an urethane bond, provided that at least one of $R_{23}$ to $R_{25}$ represents a structure including a site binding to a polymer chain of the resin via an ether bond, an ester bond, or an urethane bond]; and Formula (7)

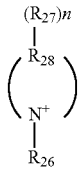

[where $R_{26}$ represents a hydrogen atom, a monovalent hydrocarbon group having 1 to 30 carbon atoms, or a structure including a site binding to a polymer chain of the resin via an ether bond, an ester bond, or a urethane bond; $R_{28}$ represents a carbon chain constituting a 4- to 6-membered ring and optionally containing a heteroatom; n represents the number of $R_{27}$ that can bind to $R_{28}$ at the number of the ring members; and $(R_{27})_n$ each independently represent a hydrogen atom, a monovalent hydrocarbon group having 1 to 30 carbon atoms, or a structure including a site binding to a polymer chain of the resin via an ether bond, an ester bond, or a urethane bond, provided that at least one of $R_{26}$ and $(R_{27})_n$ represents a structure including a site binding to a polymer chain of the resin via an ether bond, an ester bond, or an urethane bond].

2. The developing member according to claim 1, wherein the cationic structure has at least one structure selected from the group consisting of the following Formulae (2-1), (2-2), (3-1), (3-2), (3-3), (4-1), and (7-1):

Formula (2-1)

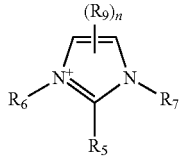

Formula (2-2)

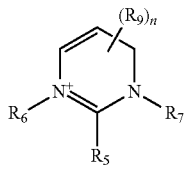

-continued

Formula (3-1)

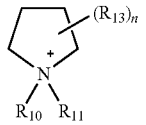

Formula (3-2)

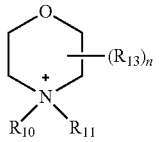

Formula (3-3)

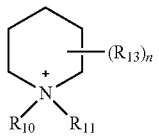

Formula (4-1)

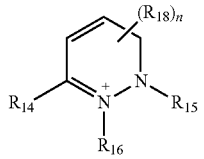

Formula (7-1)

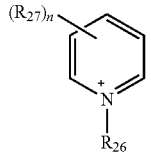

[where $R_5$ to $R_7$, $R_9$, and n in Formulae (2-1) and (2-2) are synonymous with those in Formula (2); $R_{10}$, $R_{11}$, $R_{13}$, and n in Formulae (3-1) to (3-3) are synonymous with those in Formula (3); $R_{14}$ to $R_{16}$, $R_{18}$, and n in Formula (4-1) are synonymous with those in Formula (4); and $R_{26}$, $R_{27}$, and n in Formula (7-1) are synonymous with those in Formula (7)].

3. The developing member according to claim 1, wherein the resin is a reaction product of an ion conductive agent including a cation having a reactive functional group and the anion; and a compound having a functional group that can react to the reactive functional group.

4. The developing member according to claim 3, wherein the cation has three or more reactive functional groups.

5. The developing member according to claim 3, wherein the reactive functional group is a hydroxy group or an epoxy group.

6. The developing member according to claim 3, wherein the compound has at least one group selected from an isocyanate group, a carboxyl group, and an epoxy group.

7. The developing member according to claim 1, wherein the anion is at least one selected from fluorosulfonate anions, fluorocarboxylate anions, fluorosulfonylimide anions, fluorosulfonylmethide anions, dicyanamide anions, fluoroalkylfluoroborate anions, fluorophosphate anions, fluoroantimonate anions, fluoroarsenate anions, and bis(oxalato) borate anions.

8. The developing member according to claim 1, wherein the cationic structure includes three or more structures each including a site binding to the polymer chain of the resin via an ether bond, an ester bond, or a urethane bond.

9. The developing member according to claim 1, wherein the insulating domains are convexly formed on the surface of the conductive elastic layer.

10. A process cartridge detachably attachable to a main body of an electrophotographic apparatus, comprising a developing unit, wherein the developing unit includes the developing member according to claim 1.

11. An electrophotographic apparatus comprising:

an image carrier for carrying an electrostatic latent image;

a charging unit for charging the image carrier;

an exposing unit for forming an electrostatic latent image on the charged image carrier;

a developing unit for developing the electrostatic latent image with a toner to form a toner image;

a transferring unit for transferring the toner image to a transfer material; and a fixing unit for fixing the toner image transferred on the transfer material, wherein the developing unit includes the developing member according to claim 1.

12. A method of producing a developing member, comprising the steps of:

forming a conductive elastic layer on a conductive substrate, where a material for the conductive elastic layer at least containing a resin having a cationic structure and an anion is supplied onto the conductive substrate and is cured; and forming a plurality of insulating domains on the conductive elastic layer, wherein the developing member has a surface including at least one surface of the insulating domains and an exposed portion of the conductive elastic layer not covered with the insulating domains; and the resin is prepared by reacting an ion conductive agent composed of a cation represented by any of Formulae (11) to (17) having a reactive functional group and an anion to a compound having a functional group that can react to the reactive functional group:

Formula (11)

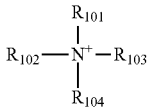

[where $R_{101}$ to $R_{104}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{101}$ to $R_{104}$ represents a group having a reactive functional group that can bind to a polymer chain of the resin via an ether bond, an ester bond, or a urethane bond];

Formula (12)

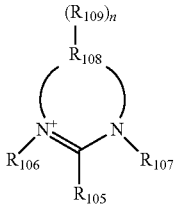

[where $R_{105}$ to $R_{107}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{108}$ represents a carbon chain constituting a 4- to 6-membered ring and optionally containing a heteroatom; n represents the number of $R_{109}$ that can bind to $R_{108}$ at the number of the ring members; and $(R_{109})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{105}$ to $R_{107}$ and $(R_{109})_n$ represents a group having a reactive functional group that can bind to a polymer chain of the resin via an ether bond, an ester bond, or a urethane bond];

Formula (13)

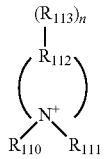

[where $R_{110}$ and $R_{111}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{112}$ represents a carbon chain constituting a 4- to 6-membered ring and optionally containing an oxygen atom or a sulfur atom; n represents the number of $R_{113}$ that can bind to $R_{112}$ at the number of the ring members; and $(R_{113})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{110}$, $R_{111}$, and $(R_{113})_n$ represents a group having a reactive functional group that can bind to a polymer chain of the resin via an ether bond, an ester bond, or a urethane bond];

Formula (14)

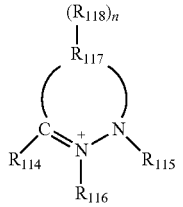

[where $R_{114}$ to $R_{116}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond; $R_{117}$ represents a carbon chain constituting a 4- to 6-membered ring and optionally containing a heteroatom; n represents the number of $R_{118}$ that can bind to $R_{117}$ at the number of the ring members; and $(R_{118})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{114}$ to $R_{116}$ and $(R_{118})_n$ represents a group having a reactive functional group that can bind to a polymer chain of the resin via an ether bond, an ester bond, or a urethane bond];

Formula (15)

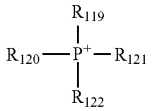

[where $R_{119}$ to $R_{122}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{119}$ to $R_{122}$ represents a group having a reactive functional group that can bind to a polymer chain of the resin via an ether bond, an ester bond, or a urethane bond];

Formula (16)

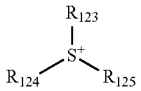

[where $R_{123}$ to $R_{125}$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{123}$ to $R_{125}$ represents a group having a reactive functional group that can bind to a polymer chain of the resin via an ether bond, an ester bond, or a urethane bond]; and Formula (17)

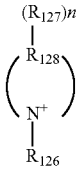

[where $R_{126}$ represents a hydrogen atom, a monovalent hydrocarbon group having 1 to 30 carbon atoms, or a structure including a site binding to a polymer chain of the resin via an ether bond, an ester bond, or a urethane bond; $R_{128}$ represents a carbon chain constituting a 4- to 6-membered ring and optionally containing a heteroatom; n represents the number of $R_{127}$ that can bind to $R_{128}$ at the number of the ring members; and $(R_{127})_n$ each independently represent a hydrogen atom, a monovalent hydrocarbon group having 1 to 30 carbon atoms, or a group having a reactive functional group that can bind to a polymer chain of the resin via an ether bond, an ester bond, or a urethane bond, provided that at least one of $R_{126}$ and $(R_{127})_n$ represents a group having a reactive functional group that can bind to a polymer chain of the resin via an ether bond, an ester bond, or a urethane bond].

13. The method of producing a developing member according to claim 12, wherein the cation has three or more reactive functional groups.

14. The method of producing a developing member according to claim 12, wherein the reactive functional group is a hydroxy group or an epoxy group.

15. The method of producing a developing member according to claim 12, wherein the compound has at least one group selected from an isocyanate group, a carboxyl group, and an epoxy group.

16. The method of producing a developing member according to claim 12, wherein the step of forming insulating domains includes a step of adding insulating particles to the material of the conductive elastic layer, curing the material of the conductive elastic layer to form a conductive elastic layer, and polishing a surface of the conductive elastic layer to expose the insulating particles.

17. The method of producing a developing member according to claim 12, wherein the step of forming insulating domains includes a step of supplying an insulating material to a plurality of positions on the surface of the cured conductive elastic layer and curing the insulating material.

18. The method of producing a developing member according to claim 17, wherein a plurality of concaves are formed on the cured conductive elastic layer, and the insulating material is supplied to the concaves and is cured.

19. The method of producing a developing member according to claim 17, wherein the insulating domains are convexly formed on the surface of the conductive elastic layer.

* * * * *